US008006929B2

(12) United States Patent
Lind et al.

(10) Patent No.: US 8,006,929 B2
(45) Date of Patent: Aug. 30, 2011

(54) END PLUG FOR A ROLL OF MATERIAL, ROLL OF MATERIAL AND RETENTION MECHANISM IN A DISPENSER

(75) Inventors: Mats Lind, Hedemora (SE); Marcus Kullman, Borlange (SE); Stig Pommer, Hedemora (SE); Allan Salaker, Vikmanshyttan (SE); Bjorn Larsson, Billdal (SE); Helmut Unger, Bobingen (DE)

(73) Assignee: SCA Hygiene Products, Gothenburg (SE)

( * ) Notice: Subject to any disclaimer, the term of this patent is extended or adjusted under 35 U.S.C. 154(b) by 513 days.

(21) Appl. No.: 12/092,119

(22) PCT Filed: Oct. 25, 2006

(86) PCT No.: PCT/EP2006/010279

§ 371 (c)(1),
(2), (4) Date: Apr. 30, 2008

(87) PCT Pub. No.: WO2007/065502

PCT Pub. Date: Jun. 14, 2007

(65) Prior Publication Data

US 2008/0230418 A1 Sep. 25, 2008

(30) Foreign Application Priority Data

Dec. 7, 2005 (EP) ..... 05026712

(51) Int. Cl.
*B65H 16/06* (2006.01)

(52) U.S. Cl. ..... 242/596.7; 242/129.51

(58) Field of Classification Search ..... 242/597, 242/599, 599.2, 599.3, 599.4, 129.51, 129.6, 242/596–596.8

See application file for complete search history.

(56) References Cited

U.S. PATENT DOCUMENTS

| | | | |
|---|---|---|---|
| 2,299,736 | A | 10/1942 | Cavoto |
| 3,387,902 | A | 6/1968 | Perrin et al. |
| 3,416,744 | A | 12/1968 | Mott, Sr. et al. |
| 3,572,602 | A | 3/1971 | Mott, Sr. et al. |
| 3,700,181 | A | 10/1972 | Diring et al. |

(Continued)

FOREIGN PATENT DOCUMENTS

| | | |
|---|---|---|
| AT | 398747 | 6/1994 |

(Continued)

OTHER PUBLICATIONS

Decision to Grant, dated Sep. 29, 2010, in Russian Application No. 2008127350.

*Primary Examiner* — William E Dondero
(74) *Attorney, Agent, or Firm* — Young & Thompson

(57) ABSTRACT

An end plug for a roll of material to be inserted into a retention mechanism, includes a receiving portion to fit into a hollow core of the roll of material; and a bearing member to fit into the retention mechanism. The bearing member includes a bearing pin having a counter surface facing the receiving portion; and a locking surface for locking the end plug in an end position in the retention mechanism, the locking surface being arranged between the receiving portion and the bearing pin, the locking surface having at least one portion inclined with respect to the longitudinal axis of the bearing pin by an angle to the longitudinal axis of the bearing pin in the range of 117° to 141°. A retention mechanism in a dispenser for retaining the end plug of an exchangeable roll of material is also disclosed.

22 Claims, 20 Drawing Sheets

U.S. PATENT DOCUMENTS

| | | | | |
|---|---|---|---|---|
| 3,771,739 | A | 11/1973 | Nelson | |
| 4,108,389 | A | 8/1978 | Womack | |
| 4,230,286 | A | 10/1980 | Charles | |
| 4,307,639 | A | 12/1981 | DeLuca | |
| 4,340,195 | A | 7/1982 | DeLuca | |
| 4,342,431 | A | 8/1982 | Watellier | |
| 4,671,466 | A | 6/1987 | Jespersen et al. | |
| 5,501,415 | A | 3/1996 | Harris et al. | |
| 5,997,195 | A | 12/1999 | Burgin | |
| 6,824,091 | B2 * | 11/2004 | Inana | 242/578.2 |
| 2003/0164994 | A1 | 9/2003 | Inana | |
| 2003/0173451 | A1 | 9/2003 | Inana | |
| 2010/0078515 | A1 | 4/2010 | Granger | |

FOREIGN PATENT DOCUMENTS

| | | | |
|---|---|---|---|
| AU | 526 111 | B2 | 12/1982 |
| FR | 2868407 | | 10/2005 |
| FR | 2 879 090 | A | 6/2006 |
| SU | 1047784 | A | 10/1983 |
| SU | 1444263 | A1 | 12/1988 |
| SU | 1818294 | A1 | 5/1993 |
| WO | 96/23719 | | 8/1996 |
| WO | 9623719 | | 8/1996 |
| WO | 2005/094652 | A1 | 10/2005 |
| WO | 2005/094653 | A1 | 10/2005 |
| WO | 2007038957 | | 4/2007 |

* cited by examiner

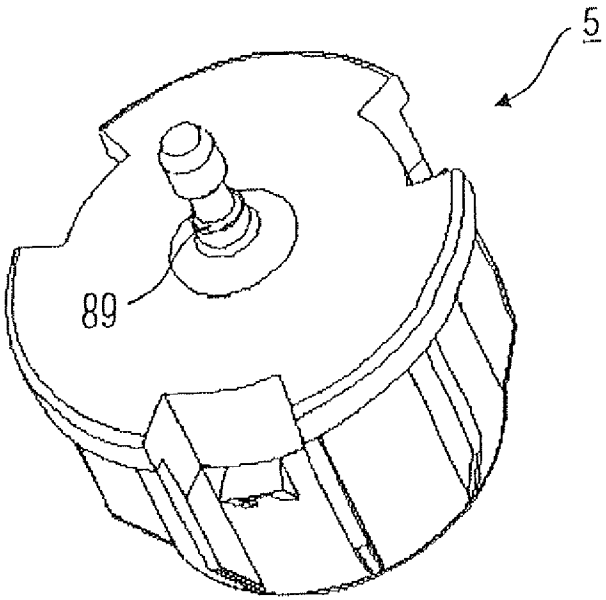
Fig. 2
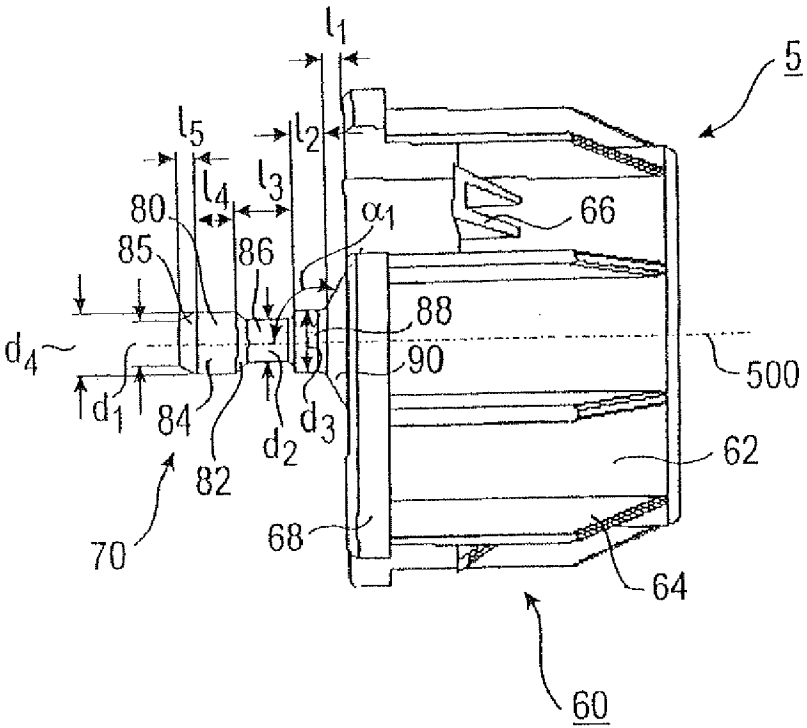

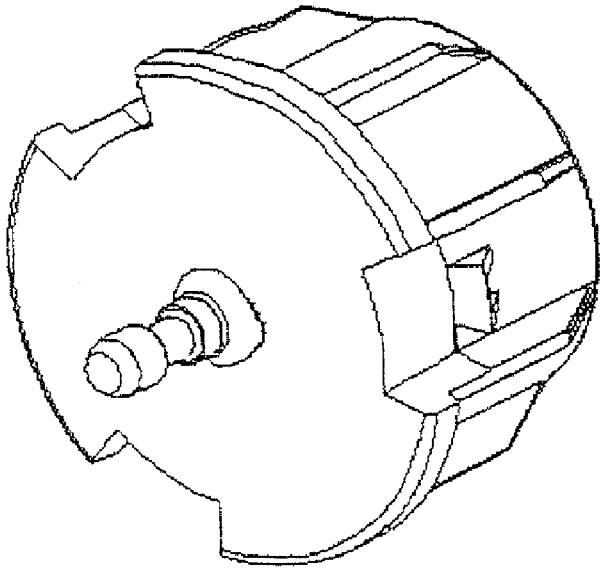
Fig. 5
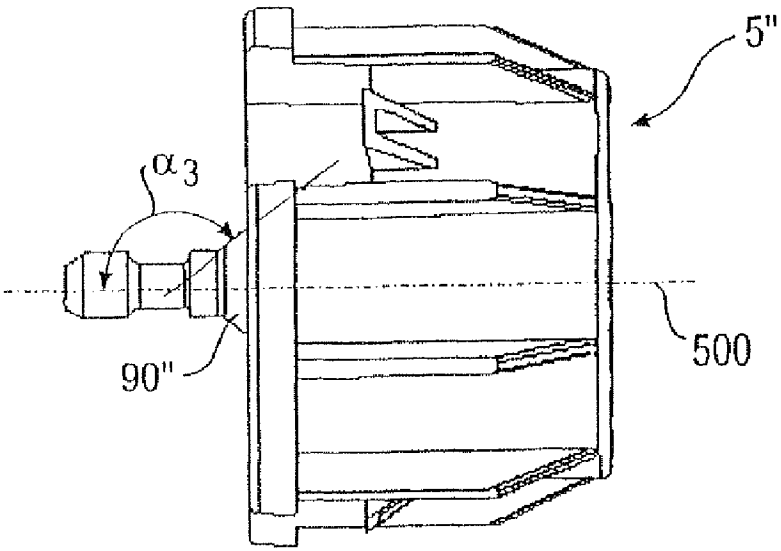

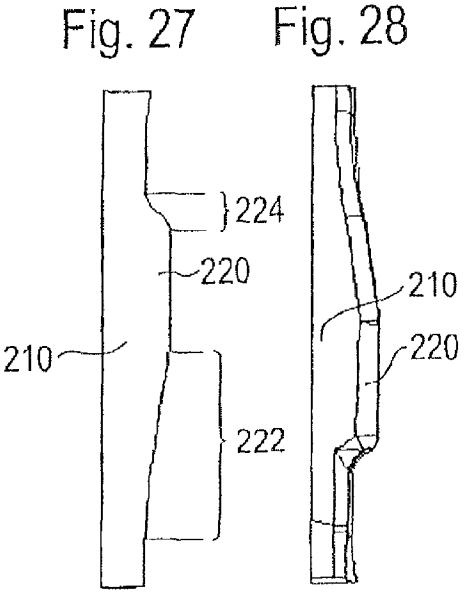
Fig. 28
Fig. 27
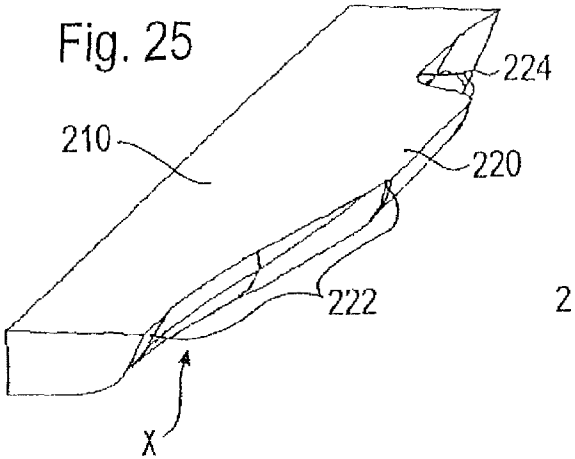
Fig. 25
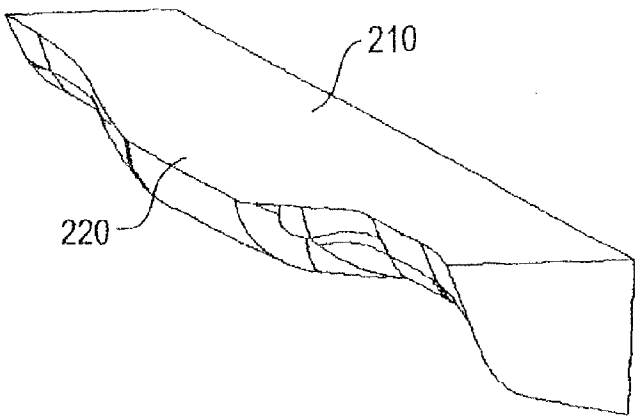
Fig. 26
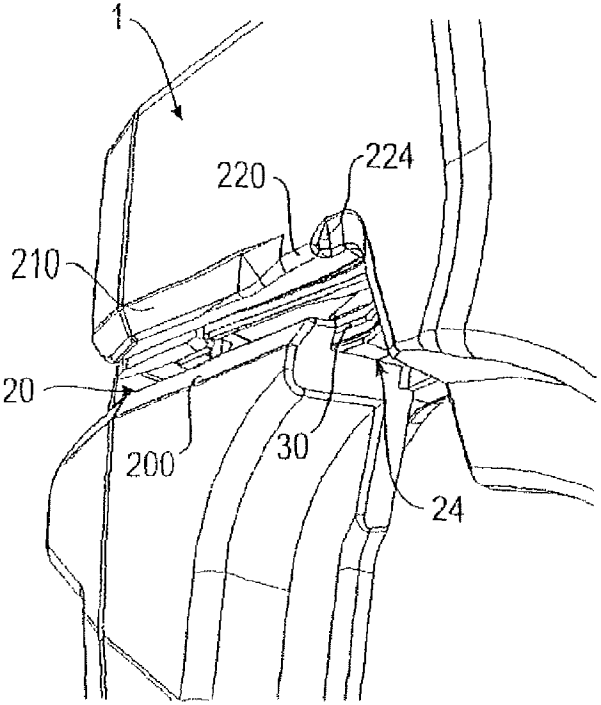
Fig. 24

END PLUG FOR A ROLL OF MATERIAL, ROLL OF MATERIAL AND RETENTION MECHANISM IN A DISPENSER

TECHNICAL FIELD

The invention relates to the technical field of dispensers for exchangeable rolls of material, in particular tissue paper rolls, and the suitable geometry for inserting such rolls into such dispensers. In particular, the invention relates to an end plug for a roll of material, in particular a roll of tissue paper, to be inserted into a retention mechanism of a dispenser.

PRIOR ART

Numerous dispensers for dispensing paper towels, kitchen paper, toilet paper, foil, plastics wrapping sheet and other materials wound onto a roll are known in the art. Usually, such dispensers are provided with a supporting guiding bracket having support members in the form of arms upon each of which an end of an exchangeable roll is rotatably mounted. The support arm usually carries a hub member rotatably supported thereon over which one end of the roll core is inserted in replacing the roll.

SUMMARY OF THE INVENTION

It is an object of the present invention to provide an end plug for a roll of material that improves the insertability of the end plug in a retention mechanism as well as that it improves the locking forces and the exchangeability of the end plug in the retention mechanism. Another object is to provide a retention mechanism for such an end plug.

This first object is solved by an end plug for a roll of material with the features of claim 1. A retention mechanism solving the second object is defined by the features of claim 22.

The basic idea of the invention is to provide a special concept for retaining an end plug in an retention mechanism by the provision of an inclined locking surface on the end plug. The idea is to provide an end plug with a receiving portion with dimensions to fit into the hollow core of a roll of material and a bearing member with dimensions to fit into the retention mechanism, the bearing member comprising a bearing pin comprising a counter surface facing the receiving portion and a locking surface for locking the end plug in an end position in the retention mechanism. The locking surface is arranged between the receiving portion and the bearing pin, the locking surface having at least one portion inclined with respect to the longitudinal axis of the bearing pin by an angle to the longitudinal axis of the bearing pin in the range of 117° to 141°.

This particular arrangement of the inclined locking surface that serves to lock the end plug in an end position has several advantages over simply providing a pin. Such an inclined surface can, on the one hand, slide better into the retention mechanism but supports, on the other hand, higher loads without being deformed. In particular, an inclined surface with such a flat angle with respect to the end face of the end plug is able to carry high loads without being deformed when compared to the loads that can be carried by a pin extending perpendicular to the end face of the end plug.

To obtain even better insertion, bearing and locking properties of the end plug, the locking surface can be inclined with respect to the longitudinal axis of the bearing pin by an angle to the longitudinal axis of the bearing pin in the range of 120° to 122°.

Preferably, the surface is inclined by an angle to the longitudinal axis of the bearing pin of 121.1°. This particular angle leads to superior properties with regard to the locking force which can be supported by the end plug and shows improved slideability and insertability of the end plug into a retention mechanism. This particular angle leads to a locking force of 18N to 19N which has been found to be a highly desirable locking force with regard to the use of rolls of material in a dispenser.

The inclined locking surface can be defined by a truncated cone, the base of the truncated cone being oriented towards the receiving portion and the top of the truncated cone being oriented towards the bearing pin. It is particularly preferred to provide the base of the truncated cone with a diameter larger than any outer diameter of the bearing pin. The top of the truncated cone can have a diameter substantially corresponding to the outer diameter of a portion of the bearing pin adjacent to the top of the truncated cone, in particular a diameter of 5 mm. Furthermore, the top of the truncated cone can have a diameter substantially corresponding to the largest outer diameter of the bearing pin, in particular a diameter of 5 mm. Such embodiment of the truncated cone defining the locking surface results in an end plug with a particularly simple design while maintaining the superior locking characteristics as described above in combination with easy insertion and exchange characteristics of the end plug.

The locking surface could also be defined by a hemisphere and/or other essentially spherical surface arrangement. This embodiment gives the freedom of different design possibilities. Important is, however, that at least one surface portion of the locking surface has the desired inclination in the range of 117° to 141°. This is certainly the case when a hemisphere is used but when using other spherical surfaces it has to be ensured that the portions of the locking surfaces that contact the retention mechanism exhibit an angle of the locking surface in this range.

To adapt the end plug to different dispenser geometries and allow increased flexibility in the design options of the end plug, a distance portion may be arranged between the locking surface and the receiving portion. Such distance portion may be cylindrical and/or have inclined surfaces with angles different to that of the locking surface. Such a distance portion can serve to adjust the distance between the locking surface and the receiving portion in order to adjust the end plug to the needs of the specific retention mechanism.

In the preferred embodiment, a limiting member is provided for limiting the depth of insertion of the receiving portion into the hollow core of the roll of material, the limiting member being situated adjacent the receiving portion. The limiting member may be flange-shaped or ring-shaped. The limiting member is advantageous to achieve a defined positional relationship between the end plug and a hollow roll of material in order to have a defined relationship between the dispenser and a roll of material such that the material can be dispensed reliably, i.e. without clogging or premature rupture.

In order to ensure that the locking surface for locking the end plug in an end position can be properly accessed by the retention mechanism, it is preferred that the locking surface extends beyond the end face of the receiving portion, in particular 2 mm beyond this plane. The plane can be defined by the end face of the limiting member.

In order to ensure proper rotation characteristics of the end plug, it is preferred that the portions that extend beyond the limiting member and/or beyond the receiving portion in the direction of the bearing pin are rotationally symmetric.

In a preferred embodiment, the bearing pin comprises at least a first portion of a first outer diameter and a second portion of a second outer diameter, the second portion being situated between the first portion of the bearing pin and the locking surface, the second outer diameter being smaller than the first outer diameter. Preferably, the counter surface is arranged between the first portion and the second portion of the bearing pin. This arrangement allows a particularly easily manufacturable arrangement for establishing the counter surface. Preferably, the counter surface extends in a plane substantially perpendicular to the longitudinal axis of the bearing pin.

In a further embodiment, the end plug comprises a third portion of a third outer diameter, the third portion being arranged between the second portion and the locking surface, the third outer diameter being larger than the second outer diameter. Preferably, a chamfer having a chamfer radius, preferably a radius of 0.5 mm, is situated between the second portion and the third portion. Such chamfer with a small chamfer radius has the advantage that an air bubble, which usually becomes embedded in the bearing pin during the injection molding process thereof, can be moved from a portion of a smaller diameter to a portion of a larger diameter in the bearing pin, i.e. in the direction of the distal end of the bearing pin. This has the advantage that the strength of the bearing pin is further increased.

In a preferred embodiment, the end plug has a locking surface that is formed such that it generates, when the end plug is inserted into a retention mechanism, a locking force of 15 N to 19 N, in particular 18 N to 19 N (Newton).

The end plug as described above can be used for fitting into the hollow core of a roll of material, in particular a paper towel roll or a tissue paper roll.

The present invention, furthermore, provides a roll of material for use in a retention mechanism which is provided, at least at one longitudinal end of the roll, with an end plug as described above.

A retention mechanism in a dispenser for retaining an end plug of an exchangeable roll of material is defined by a housing with an insertion slot for inserting a bearing member of the end plug, the insertion slot being arranged between an upper and a lower guide rail, the guide rails having at least an inclined sliding surface for interaction with an inclined locking surface of the bearing member. Furthermore, a locking member formed in at least one of the guide rails is provided, the locking member being formed such that it interacts with the inclined locking surface of the bearing member for retaining the end plug in an end position and a counter bracket being arranged in the housing, said counter bracket having a guiding slot for guiding the bearing pin of the bearing member.

Such a retention mechanism ensures that the interaction between the end plug, as described above, and the retention mechanism itself allows easier insertion and removal of the end plug or a roll of material and ensures a locking force in the desired range of 15 N to 19 N, in particular 18 N to 19 N.

Preferably, the locking member is formed on the inclined sliding surface of one of the guide rails. The locking member can be a protrusion extending perpendicular to the insertion slot.

To achieve defined insertion and removal characteristics, the locking member can have a first sloped portion arranged, in the insertion direction, before the locking member and a second sloped portion arranged, in the insertion direction, behind the locking member, the first sloped portion having a smoother slope than that of the second sloped portion. The sloped portions thus formed ensure a proper interaction with the inclined surface of the end plug and ensure easy insertion and proper locking forces. The asymmetrically formed slope portions allow different insertion forces and removal forces of the end plug when inserted into and pulled out of the retention mechanism. In other words, these features relate to a retention mechanism that allows easy insertion of a roll but retains the roll securely in the retention mechanism.

In a preferred embodiment, the locking member is formed by decreasing the inclination angle of the inclined sliding surface of the guide rail. This leads to an interaction with the inclined locking surface of the end plug which presses the end plug out of the insertion slot in a direction in the longitudinal axis of the bearing pin.

Preferably, the inclined sliding surfaces are inclined with respect to a plane extending in the insertion direction of the insertion slot and perpendicular to an outer surface of the housing by an angle to the plane in the range of 117° to 141°. Preferred, the angle is chosen in a range of 120° to 122°. In a specifically preferred embodiment, the inclination angle is 121.1°. These angles ensure that an interaction with the inclined locking surfaces of the end plug is possible and a smooth insertion of the end plug into the end position of the retention mechanism is ensured.

In a further preferred embodiment, a prevention member is provided in the insertion slot for prevention of the insertion of an end plug with incorrect dimensions. By the provision of this prevention member, it can be ensured that only rolls with suitable dimensions and suitable material are inserted into the retention mechanism and, in addition to this, it can be ensured that a roll of material is inserted in the correct orientation when providing different plugs on the ends of the material rolls.

It is preferred that the counter bracket carries a locking protrusion for retaining the end plug in its end position, the locking protrusion of the counter bracket extending in a direction opposite to that of the locking protrusion of the guide rail in the end position. Preferably, the counter bracket is pivotable within in the housing. Such a counter bracket helps to reject unsuitable end plugs and keeps suitable end plugs reliably in an end position.

BRIEF DESCRIPTION OF THE DRAWINGS

In the following, exemplary embodiments of the invention will be described in detail with reference to schematic drawings, in which:

FIG. 2 is a side view and a perspective view of the end plug in a first embodiment;

FIG. 5 is a side view and a perspective view of the end plug in a third embodiment;

FIG. 24 is a perspective view of the housing of the retention mechanism;

FIG. 25 is a perspective view of the upper guide rail of the insertion slot in a front view;

FIG. 26 is a perspective view of the back side of the upper guide rail of the insertion slot;

FIG. 27 is a top view of the upper guide rail of the insertion slot;

FIG. 28 is a bottom view of the upper guide rail of the insertion slot;

DETAILED DESCRIPTION OF THE PREFERRED EMBODIMENTS

Figure 1:
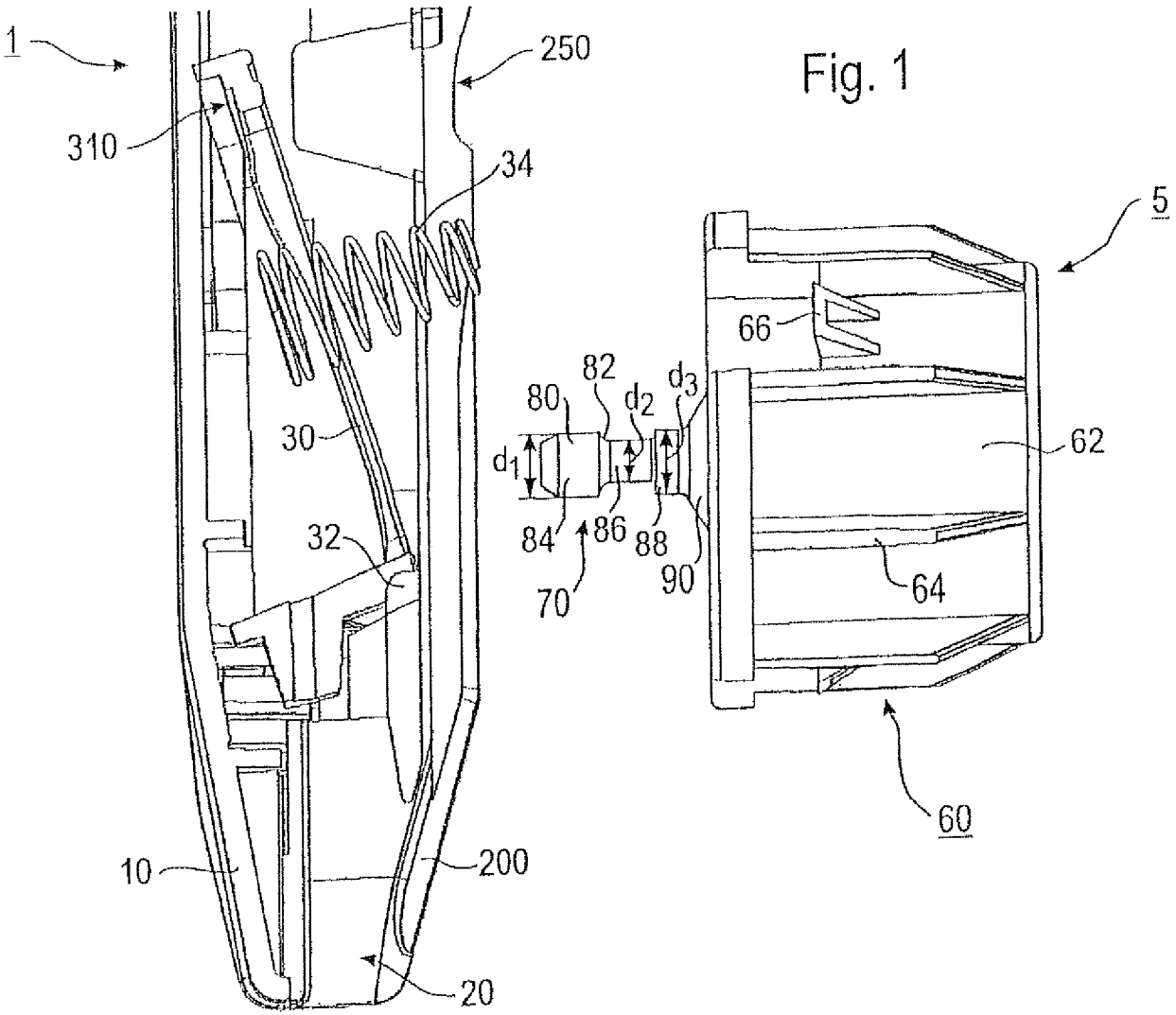
FIG. 1 is a schematic cross-section of the retention mechanism and a side view of the end plug.

In the following description of preferred embodiments of the invention, corresponding parts or elements in the different drawings will be denoted by the same reference numerals FIG. 1 is a cross-section through a retention mechanism 1 and a side view of an end plug 5 that can be retained in the retention mechanism 1.

The retention mechanism 1 comprises a housing 10 which is preferably made from a molded plastic material. The housing 10 comprises an insertion slot 20 for the insertion of the bearing member 70 of the end plug 5. A counter bracket 30 is pivotably arranged within the housing 10 and can pivot about a pivoting axis 32. The counter bracket 30 is pre-tensioned towards an insertion position by a spring 34 which is schematically shown in FIG. 1.

The insertion slot 20 is formed by an upper and a lower guide rail in the housing, the upper guide rail 200 of which is shown in the cross-section of FIG. 1. The insertion slot 20 has an end position 250 in which the end plug 5 is retained in its end position.

The end plug 5 has a receiving portion 60 with dimensions to fit into a hollow core (not shown) of a roll of material (not shown), in particular a roll of tissue paper material such as paper towels or toilet paper. The receiving portion comprises a cylindrical portion 62 and a plurality of ribs 64 that expand radially from the cylindrical portion 62. The hollow core of the roll of material is fitted onto the summit portions of the radially expanding ribs 64. A fluke portion 66 that is equally extending radially from the cylindrical portion 62 of the receiving portion 60, serves to hold the hollow roll of material in place when the end plug is fitted into the core. The fluke portions 66 extend beyond the radial expansion of the ribs 64 such that they enter into the core material in order to secure the end plug in the core.

The end plug 5 comprises a bearing member 70 which extends away from the receiving portion in the axial direction of the end plug 5. The bearing member 70 has a bearing pin 80 which comprises a counter surface 82 that faces into the direction of the receiving portion 60.

The counter surface 82 of the bearing pin 80 is formed by a first portion 84 of the bearing pin of a first outer diameter $d_1$ that springs back into a second portion 86 of the bearing pin that has an outer diameter $d_2$, whereas the first diameter $d_1$ is larger than the second diameter $d_2$. The counter surface 82 is situated between the first portion 84 and the second portion 86 of the bearing pin 80. The counter surface 82 may have different forms and can be inclined with regard to the longitudinal axis of the bearing pin, perpendicular to the longitudinal axis of the bearing pin 80 or chamfered.

Furthermore, the bearing pin 80 includes a third portion 88 of a third outer diameter $d_3$ whereas the third outer diameter $d_3$ is shown in the embodiment to be equal to the first diameter $d_1$.

The second portion 86 of the bearing pin 80 is situated between the locking surface 90 and the first portion 84 of the bearing pin 80.

The bearing member 70 also includes a locking surface 90 for locking the end plug in an end position in the retention mechanism 1, the locking surface 90 being arranged between the receiving portion 60 and the bearing pin 80. The locking surface 90 is inclined with respect to the longitudinal axis of the bearing pin by an angle in the range of 117° to 141°, in particular 120° to 122°, preferably of 121.1°.

The locking surface 90 and the counter surface 82 are arranged such that they are inclined in opposite directions. In other words, the two surfaces are arranged to constitute a potential well.

The interaction of the end plug 5 with the retention mechanism 1 will become more apparent in the description of the following FIGS. 6 to 32. In short the locking surface 90 interacts with the respective sliding surfaces of the guide rails and interacts with a locking member in order to lock the end plug 5 in its end position 250. The counter surface 82 is in contact with the guiding bracket 30 and interacts with the end section 310 of the guiding bracket 30. In the end position 250, the locking force of the end plug 5 in the retention mechanism 1 is, due to the specific geometry of the retention mechanism 1 in interaction with the bearing member of the end plug in the range of 15 N to 19 N. This very narrow band of locking force is necessary, on the one hand side, to keep the roll of material in place and securely fasten the roll of material in the end position 250 but, on the other hand, enables an easy insertion and removal of the roll of material when the roll has to be exchanged.

FIG. 2 is a side view and a perspective view of an end plug 5 in a first embodiment. The end plug 5 is identical to the end plug shown in FIG. 1 in this first embodiment. The angle $\alpha_1$ that is measured between the longitudinal axis 500 of the end plug 5 and the locking surface 90 is 121.1°. The longitudinal axis 500 of the end plug 5 is, at the same time, the longitudinal axis of the bearing pin 80. In combination with the counter surface 82, this specific angle of 121.1° ensures that the end plug 5 is held within the retention mechanism with a locking force of 18 N to 19 N.

The further dimensions shown in FIG. 2 are $d_1$=5.0+−0.2 mm $d_2$=3.5+−0.1 mm, $d_3$=5.0+−0.2 mm and $d_4$=3.5+−0.1 mm. $d_4$ is the front end face diameter of the bearing pin 80 which is reached at the end of the chamfer 85.

A limiting member 68 is arranged between the receiving portion 60 and the bearing member 70. The limiting member 68 is for limiting the depth of insertion of the receiving section 60 of the end plug 5 into the hollow core of the roll of material. In other words, the limiting member 68 serves the purpose to bring the end plug 5 into a defined position with regard to the hollow core of the material roll.

The bearing member 70 exhibits the following dimensions in the longitudinal direction of the longitudinal axis 500. The length $l_1$ of the locking surface 90 in the longitudinal direction is 2 mm. The length $l_2$ of the third portion 88 of the bearing pin 80 is 2.5 mm. The length 13 of the second portion 86 of the bearing pin 80 is 5 mm. The length of the distal-most portion of the bearing pin 80 is $l_4+l_5$=5 mm, whereas the first portion 84 has a longitudinal extension of $l_4$=3.5 mm and the chamfered portion 85 has a longitudinal extension of $l_5$=1.5 mm.

A radius of a chamfer 89 between the second portion 86 and the third portion 88 of the bearing pin 80 has a radius of 0.5 mm. The same radius can be present in the foot area of the locking surface 82.

The chamfer 89 is particularly helpful during the molding process of the end plug 5 since an air bubble that appears embedded randomly in the smaller diameter portion 86 of the bearing pin 80 can be moved by the provision of the chamfer 89 into the larger diameter portion 84. Thus, the chamfer 89 helps to improve the stability of the bearing pin of the end plug.

Figure 3:
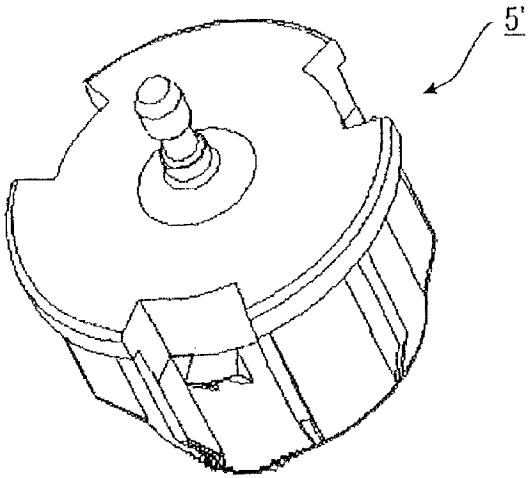
FIG. 3 is a side view and a perspective view of the end plug in a second embodiment.

FIG. 3 shows an end plug 5' in a second embodiment. The end plug 5' shown in FIG. 3 is almost identical to the one shown in FIG. 2 except that the locking surface 90' is inclined towards the longitudinal axis 500 of the bearing pin 80 by an angle of $\alpha_2$ of 117°.

Figure 4:
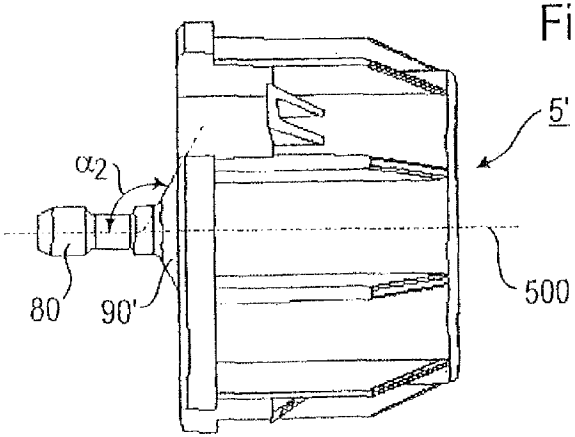
FIG. 4 is a cross-section of the retention mechanism with the end plug of FIG. 3 inserted therein.
Figure 4:
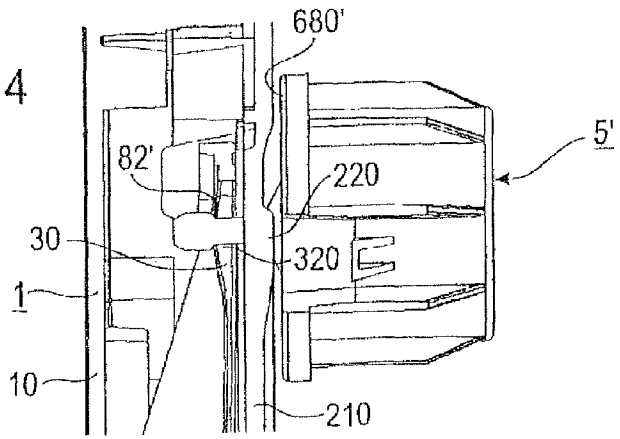

The interaction of the locking surface 90' of this end plug 5' with the retention mechanism 1 can be taken from FIG. 4.

The interaction of the locking surface 90' with the upper guide rail 210, in particular with a locking protrusion 220 of the upper guide rail 210, leads to a situation in which the end face 680' of the end plug 5' is lifted off the outer surface of the retention mechanism 1 in order to overcome the locking protrusion 220. The end plug 5' cannot, however, move further outwards in the axial direction of the end plug since the counter bracket 30 that interacts with the counter surface 82' of the end plug 5', does not permit any further movement in this direction.

In other words, the angle $\alpha_2$=1170 of the locking surface 90' of the embodiment shown is the smallest angle (steepest slope) which can be slid into the end position. At an even smaller angle the end plug cannot slide past the locking protrusion 220 of the of the guide rail 210 and past the locking protrusion 320 of the guiding bracket 30. In other words, the end plug 5' cannot be fixed in the end position when the inclination of the locking surface 90 is smaller than 117°.

FIG. 5 shows yet another end plug 5" which is substantially identical to the end plugs shown in FIGS. 2 and 3 except for the inclination angle of the locking surface. In the third embodiment of the end plug 5", the inclination angle $\alpha_3$ of the locking surface 90" is 141°. This is the other extreme angle which just permits locking of the end plug in the end position in the retention mechanism. At angles larger than 141°, the end plug 5" cannot be locked by the locking member of the retention mechanism 1. For an angle larger than 141°, the end plug 5" will not at all be locked and falls out of the retention mechanism.

From the discussion of FIGS. 2 to 5, it follows that the inclination of the locking surface for locking the end plug in the end position in the retention mechanism is of outmost importance. For angles in a range between 117° and 141°, the end plug can, on the one hand, be slid into the end position and, on the other hand, can be locked with an reasonable locking force in the end position of the retention mechanism. There is, however, only one angle of the locking surface, namely an angle 121.1°, at which the locking characteristics of the plug are at an optimum and exhibit a locking force of 18 N to 19 N.

This is of particular interest since, on the one hand, the locking force has to be high enough to keep the end plug reliably in its end position upon use but, on the other hand, the loading and removing of the rolls has to be easy in order to give the operator the perception of a hassle-free exchange of the rolls and, additionally, prevent the locking mechanism and the end plug from being destroyed. The smaller the angle is between 121.1° and 117°, the harder it is to pull out the plug from the retention mechanism. The larger the angle is between 121.1° and 141°, the easier it is to pull out the plug of the retention mechanism. The inclination angle of the locking surface has, therefore, to be carefully chosen in order to assert the optimum insertion force and optimum locking force on the end plug.

One particular advantage of using an inclined locking surface that is very close to the receiving portion of the end plug is that the forces acting on the bearing member when the end plug is rotated during use almost fully act on this inclined locking surface. Therefore, the leverage of on the bearing member is very small and the end plug does tilt when being used. Furthermore, tilting is prevented during insertion, retention and removal of the end plug when it is inserted into the retention mechanism or pulled out of the retention mechanism when an empty roll has to be replaced by a full roll.

These advantageous properties of the end plug can only be achieved by a combination of the carefully chosen angle of the locking surface in combination with an equally carefully chosen length of the bearing pin which carries a counter surface to the locking surface. However, the forces acting on the counter surface 82 of the end plug are in the direction of the longitudinal axis 500 of the plug only. Substantially no forces are acting on the bearing pin perpendicular to the longitudinal axis 500 of the end.

Figure 6:
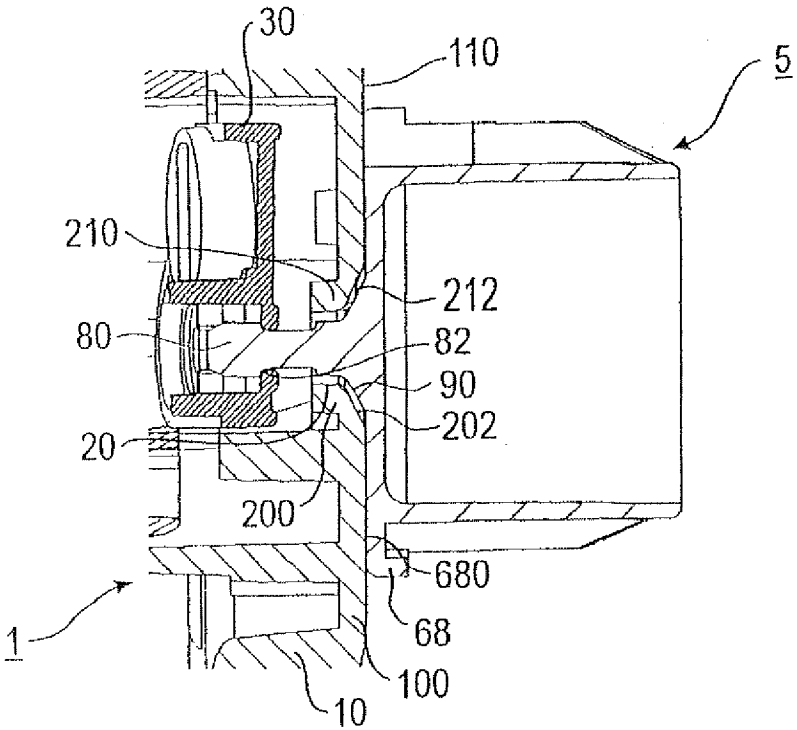
FIG. 6 is a front view cross-section of the retention mechanism and the end plug according to FIG. 2 inserted therein.

FIG. 6 is a front-view cross section of the retention mechanism 1 and the end plug 5 of the first embodiment (with a locking surface of an inclination angle of 121.1°) inserted into the retention mechanism 1. Here, a situation is shown in which the end plug 5 is inserted into the insertion slot 20 and the counter surface 82 of the bearing pin 80 is engaged with the counter bracket 30 and, consequently, pulls the counter bracket 30 in the direction of the end plug 5. The counter surface 82 exerts a force onto the counter bracket 30 in the direction of the longitudinal axis 500 of the bearing pin 80, the force acting perpendicular to the insertion direction of the insertion slot 20 and resulting in swinging the counter bracket towards the outer wall 100 of the housing 10. The outer surface 110 of the outer wall 100 of the housing 10 and the end face 680 of the limiting member 68 are in contact with each other and provide the reaction force to the pulling force that is exerted onto the counter bracket 30.

The insertion slot 20 is formed in the outer wall 100 of the housing 10 and comprises a lower rail 200 and an upper rail 210 whereas the lower rail 200 has an inclined sliding surface 202 and the upper guide rail 210 has an inclined sliding surface 212. The inclined sliding surfaces 202, 212 are inclined such that their inclination angle substantially corresponds to the inclination angle of the locking surface 90 of the bearing member 70 of the end plug 5. In the current case this means that the inclined sliding surfaces 202, 212 are inclined by an angle of 121.1°. Depending on the end plug used, the inclination could also be chosen to be in a range of 117° to 141°, and in particular 120° to 122°.

In the position of the end plug 5 shown in FIG. 6, the inclined surfaces 202, 212 of the insertion slot 20 do not, however, abut against the locking surface 90 of the end plug 5.

Figure 7:
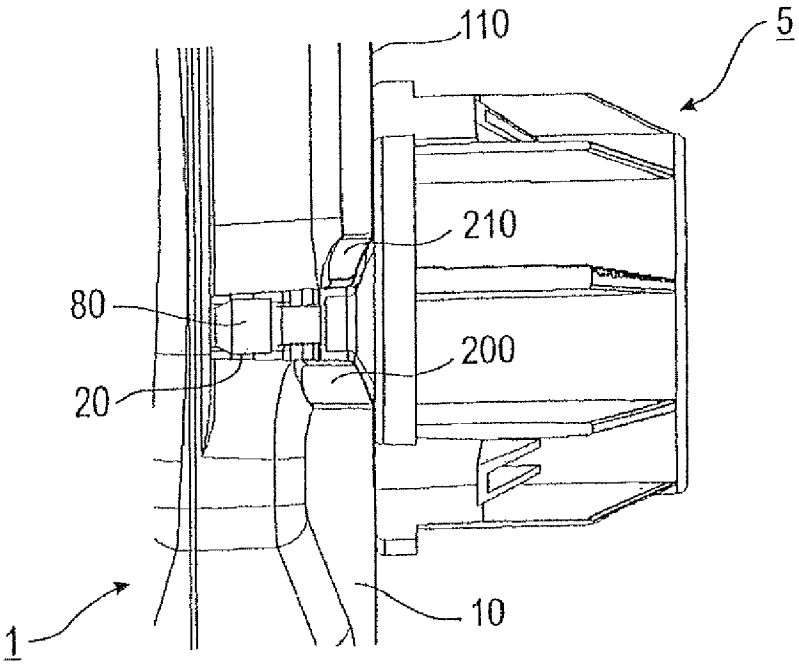
FIG. 7 is a non-sectioned front view of FIG. 6.

FIG. 7 shows the end plug 5 in the retention mechanism 1 in the same configuration as shown in FIG. 6 but in a non-sectioned view. In this Figure it is clearly visible how the bearing pin 80 enters into the insertion slot 20 and how it is guided along the insertion slot such that the end plug 5 can only slide along the insertion slot 20.

Figure 8:
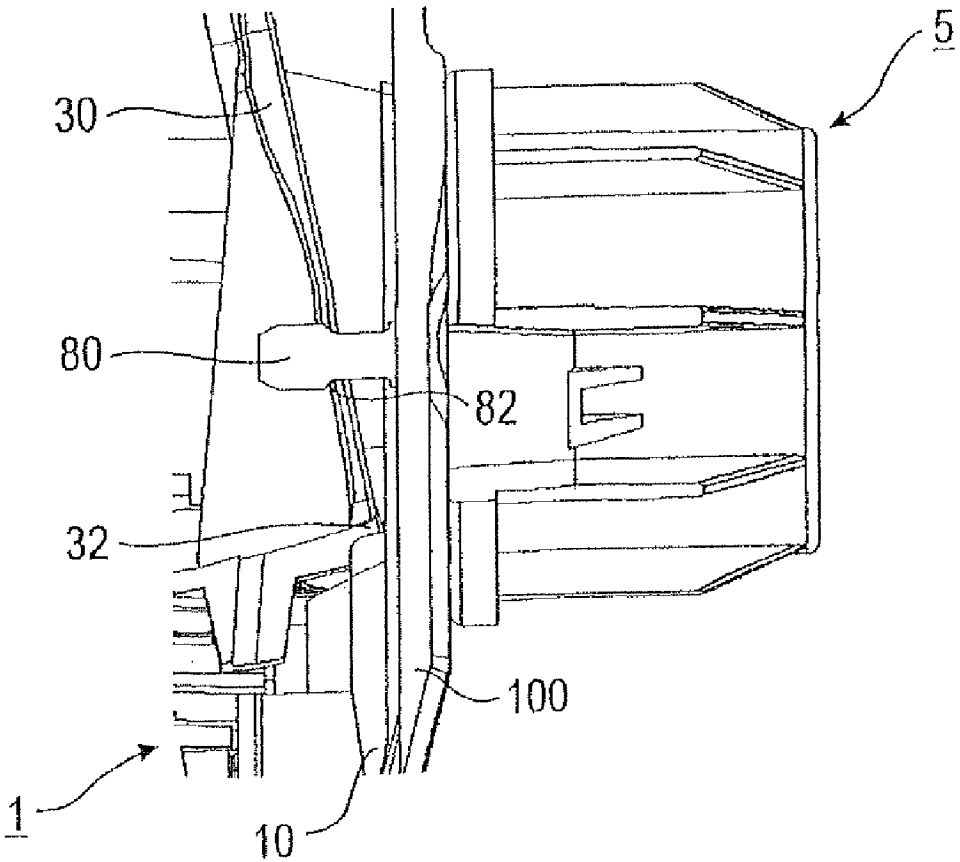
FIG. 8 is a top view of the arrangement of FIGS. 6 and 7 with parts of the housing of the retention mechanism cut away.

FIG. 8 is an illustration of the end plug in a top-view cross section, the end plug being further slid into the insertion slot of the retention mechanism 1. In this illustration it becomes even more clear how the interaction between the counter surface 82 of the bearing pin 80 with the counter bracket 30 brings the counter bracket 30 more and more in an orientation towards the outer wall 100 of the housing 10. In other words, the interaction of the counter surface 82 of the bearing pin 80 and the counter bracket 30 pivots the counter bracket 30 around the pivoting axis 32 of the counter bracket 30 towards the outer wall 100 of the housing 10 such that, in the end position of the counter bracket 30, the counter bracket 30 is in parallel to the outer housing wall 100 and, thus, parallel to the insertion direction of the end plug 5.

FIGS. 9 to 13 show the end plug 5 and the retention mechanism 1 in different views in a position in which the end plug 5 is moved further towards the end position. In particular, in FIG. 9 a situation is shown in which the end plug is moved this far that the inclined surface 212 of the upper rail 210 begins to abut against the locking surface 90 of the end plug 5.

Figure 10:
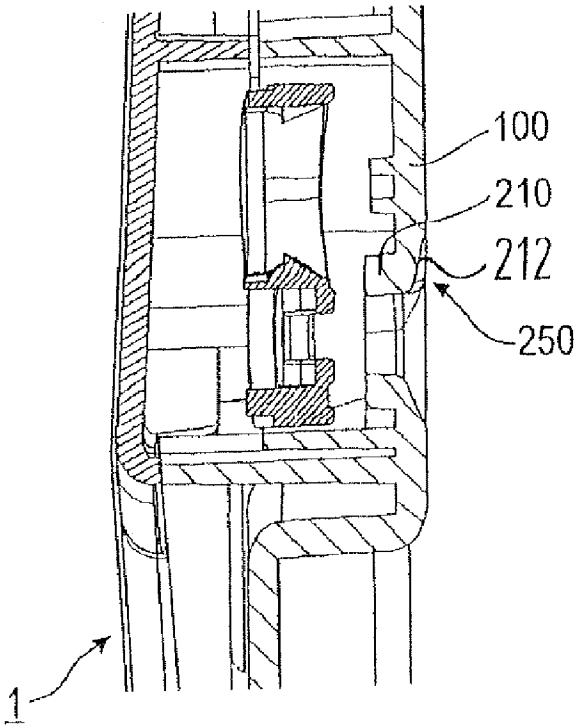
FIG. 10 is a cross-section of the retention mechanism of FIG. 9 without the end plug inserted therein.
Figure 9:
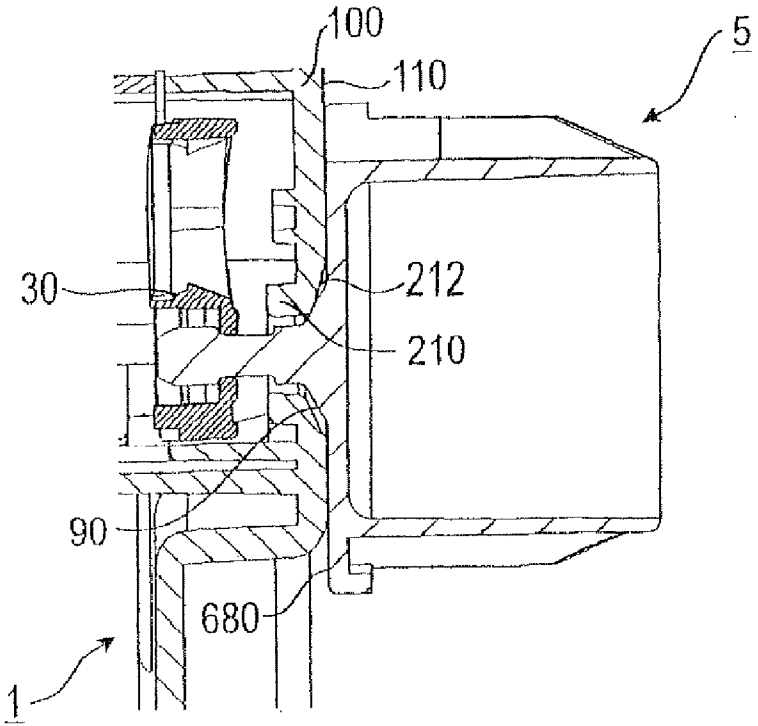
FIG. 9 is a cross-section of the end plug and the retention mechanism in a position of the end plug before sliding past the locking member of the retention mechanism.

FIG. 10 is a cross section through the retention mechanism 1 alone showing the outer wall 100 of the retention mechanism with the upper guide rail 210 whereas the inclination of the inclined portion 212 varies as it extends towards the end position 250 of the retention mechanism.

Figure 11:
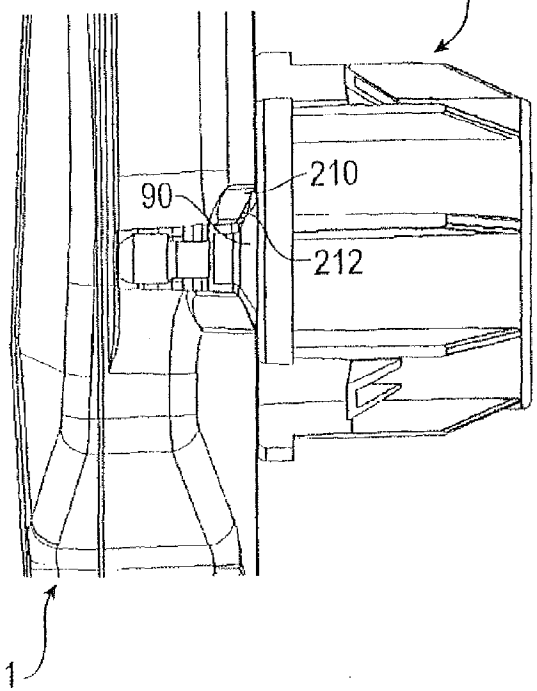
FIG. 11 is a non-sectioned front view of the retention mechanism with the end plug inserted therein in the position shown in FIG. 9.

FIG. 11 shows the end plug 5 in the retention mechanism 1 in a non-sectioned front view, the interaction between the inclined locking surface 90 of the end plug 5 and the upper guide rail 210 and in particular the inclined surface 212 of the upper guide rail 210 being clearly visible.

Figure 12:
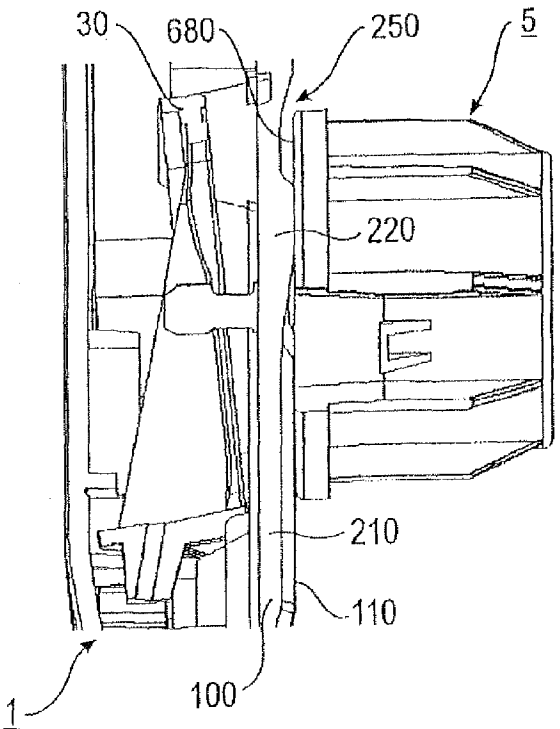
FIG. 12 is a top view of the retention mechanism and the end plug in a position as shown in FIGS. 10 and 11 with parts of the housing of the retention mechanism cut away.

FIG. 12 shows the same position of the end plug 5 in the retention mechanism 1 in a top-view cross section. The end plug 5 moves towards the end position 250. The end position 250 is defined, as will become more apparent in the following drawings, by a locking protrusion 220 which is formed in the upper guide rail 210. The interaction of the upper guide rail 210 and the locking protrusion 220 with the bearing member 70 of the end plug 5 is shown in more detail in FIG. 13.

Figure 13:
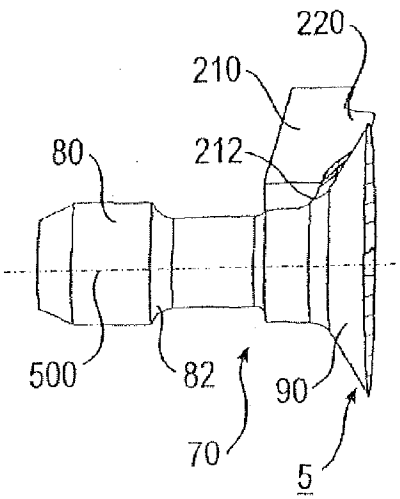
FIG. 13 is an enlargement of the contact portion between a bearing member of the end plug in interaction with the upper guide rail and the locking member in the insertion slot of the retention mechanism.

FIG. 13 shows the upper guide rail 210 and the locking protrusion 220. The inclined surface 212 of the upper guide rail 210 changes its inclination slightly towards the locking protrusion 220. More important is, however that the locking protrusion 220 extends in the direction parallel to the longitudinal axis 500 of the bearing pin. Thus, the interaction between the locking protrusion 220 and the end plug 5, in particular between the locking surface 90 and the locking protrusion 220, leads to a movement of the end plug 5 in the direction of the longitudinal axis 500 of the bearing pin 80 such that the end face 680 of the limiting member 68 is lifted off the outer surface 110 of the front wall 100, as will be explained with reference to FIG. 14 below.

In other words, the locking protrusion 220 exerts a force onto the inclined locking surface 90 which moves the end plug 5 in a direction away from the outer surface 110 of the housing 10 of the retention mechanism 1. On the other hand the counter surface 82 of the bearing pin 80 interacts with the counter bracket 30 (not shown in FIG. 13) such that an elastic tension is built up between the locking protrusion 220 and the counter bracket 30.

FIGS. 14 to 17 show the end plug 5 in the retention mechanism 1 in a yet further moved position in which the outer surface 680 of the limiting member 68 of the end plug 5 is lifted off the outer surface 110 of the retention mechanism 1. This is due to the fact that the locking surface 90 of the end plug 5 abuts against the locking protrusion 220 of the upper guide rail 210. The counter bracket 30 is pressed against a portion of the housing 10 by the interaction between the locking surface 90 and the locking protrusion 220 and the counter surface 82 and the counter bracket 30 such that an elastic tension is built up acting on the bearing member 70 of the end plug. In this situation, the insertion force of the end plug 5 into the insertion slot 20 is higher than in the positions described before. In other words, an operator inserting the end plug 5 feels quite a resistance acting against the further insertion of the end plug. In order to overcome this resistance, which is due to the higher friction and the elastic tension, the operator needs to push the end plug 5 harder into the retention mechanism 1. In other words, the operator can feel that the end plug is almost in its end position but is still movable in the insertion direction.

Figure 15:
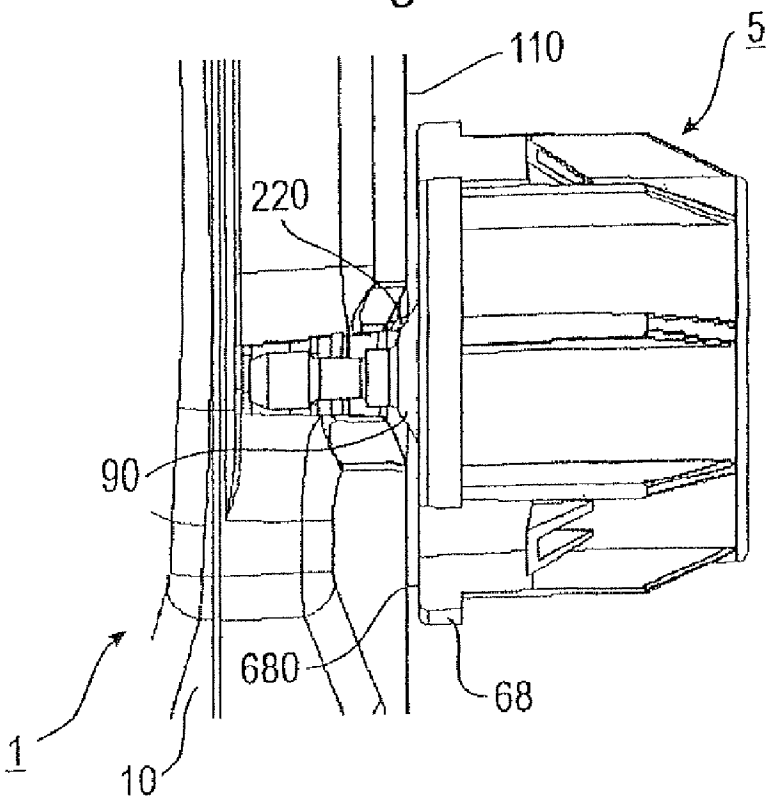
FIG. 15 is a non-sectioned front view of FIG. 14.
Figure 14:
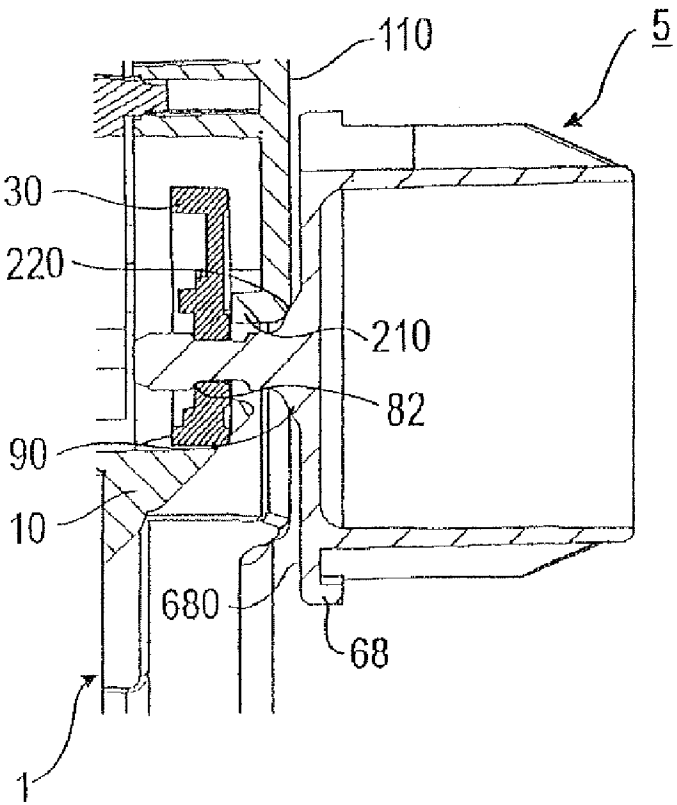
FIG. 14 is a cross-section of the retention mechanism with the end plug inserted therein in a position in which the end plug slides past the locking member of the upper guide rail of the retention mechanism.

FIG. 15 shows the same position of the end plug 5 in the retention mechanism 1 that was shown in FIG. 14 but in a non-sectioned front view. Here, again, it is clearly visible that the front face 680 of the end plug 5 is lifted off the outer surface 110 of the housing 10 of the retention mechanism due to the interaction of the locking protrusion 220 and the locking surface 90 of the end plug.

Figure 16:
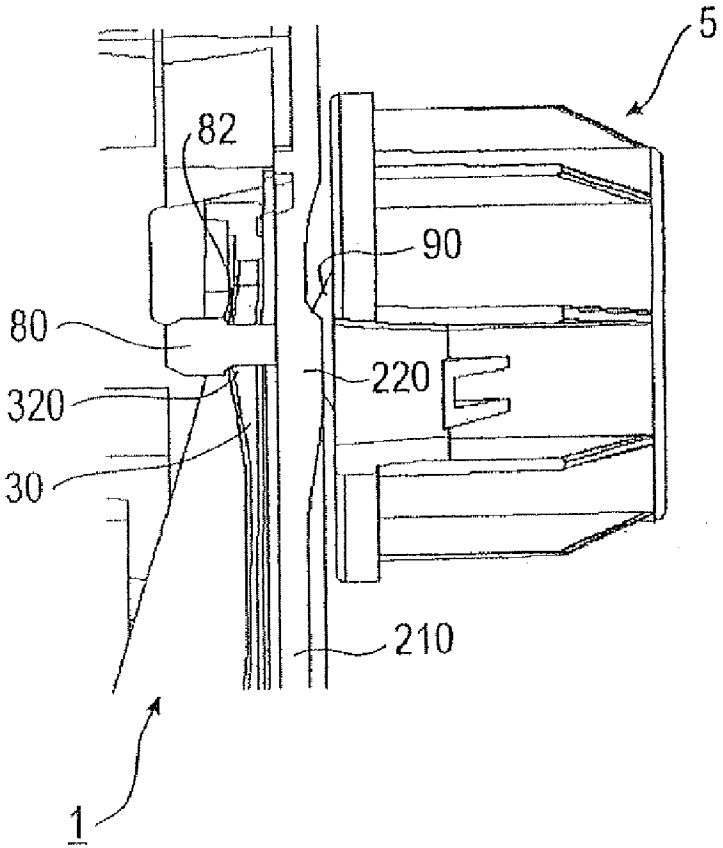
FIG. 16 is a top view of the retention mechanism with the end plug inserted therein in the position shown in FIGS. 14 and 15 with parts of the housing of the retention mechanism being cut away.

FIG. 16 shows the same situation as in FIGS. 14 and 15 but in a top-view with parts of the housing broken away. The upper guide rail 210 and the locking protrusion 220, which interacts with the locking surface 90 of the bearing member 70 is shown.

It is to be noted that the counter bracket 30 also comprises locking protrusions 320 which extend in a direction opposite to that of the locking protrusion 220 of the upper guide rail 210. The locking protrusions 320 of the counter bracket 30 interact with the counter surface 82 of the bearing pin 80 of the end plug 5. Consequently, the distance between the counter surface 82 of the bearing pin 80 and the contact area of the upper guide rail 210 with the locking surface 90 of the end plug 5 is increased such that an elastic tension is built up between these two facing surfaces. The dimensions of the locking protrusion 220 of the upper guide rail 210 and the locking protrusion 320 the counter bracket 30 are balanced such that the end plug 5 can be slid into its end position over the locking protrusions 220, 320 with a pushing force that is not unduly high.

Figure 17:
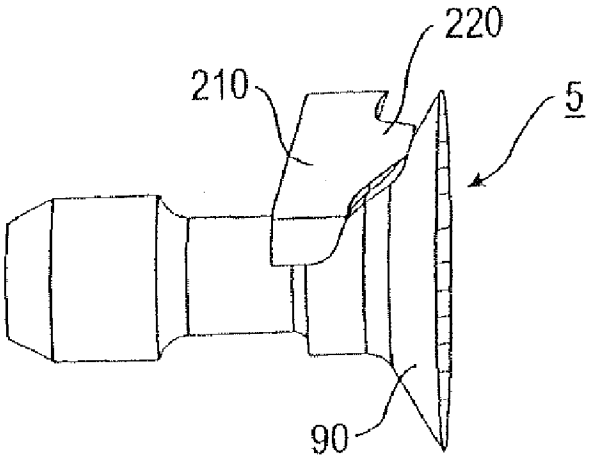
FIG. 17 is an enlargement of the contact portion between the bearing member of the end plug in interaction with the upper guide rail and the locking member in the insertion slot of the retention mechanism.

FIG. 17 shows, in an enlarged view, the interaction of the locking surface 90 of the end plug 5 with the locking protrusion 220 of the upper guide rail 210 in the position of the end plug 5 in the retention mechanism 1, as it is shown in FIG. 16.

FIGS. 18 to 23 show the end plug 5 in its end position in the retention mechanism 1. The end face 680 abuts against the outer surface 110 of the housing 10 again. In other words, the end plug 5 has overcome the locking protrusions 220, 320 that were discussed in FIG. 16 and has moved back into a position abutting against the housing 10 of the retention mechanism 1.

Figure 19:
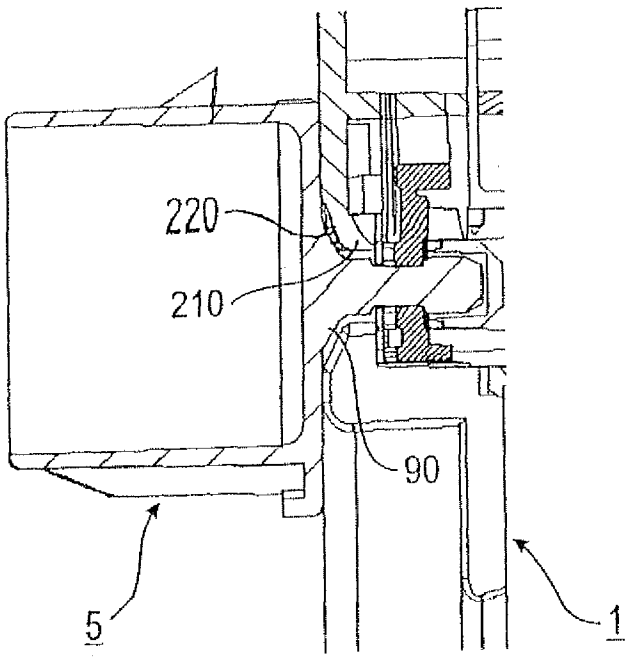
FIG. 19 is a back cross-sectional of the retention mechanism and the end plug of FIG. 18.
Figure 18:
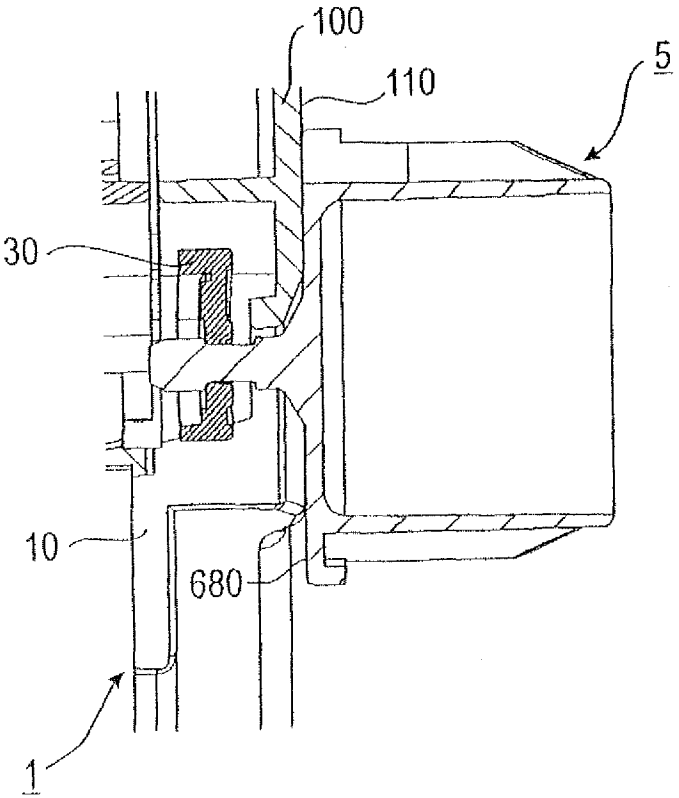
FIG. 18 is a front cross-section of the retention mechanism with the end plug inserted therein its end position.

The counter bracket 30 sprung back into a position where it is parallel to the outer wall 100 of the retention mechanism 1. FIG. 18 shows the cross section of the end plug 5 in the retention mechanism 1 in a cross section front view. FIG. 19 shows the end plug 5 in the retention mechanism 1 in the same position of the end plug in a back side view. In this back side view, the locking protrusion 220 of the upper guide rail 210 is visible that interacts with the locking surface 90 of the end plug 5 and prohibits the end plug 5 from exiting the end position.

Figure 20:
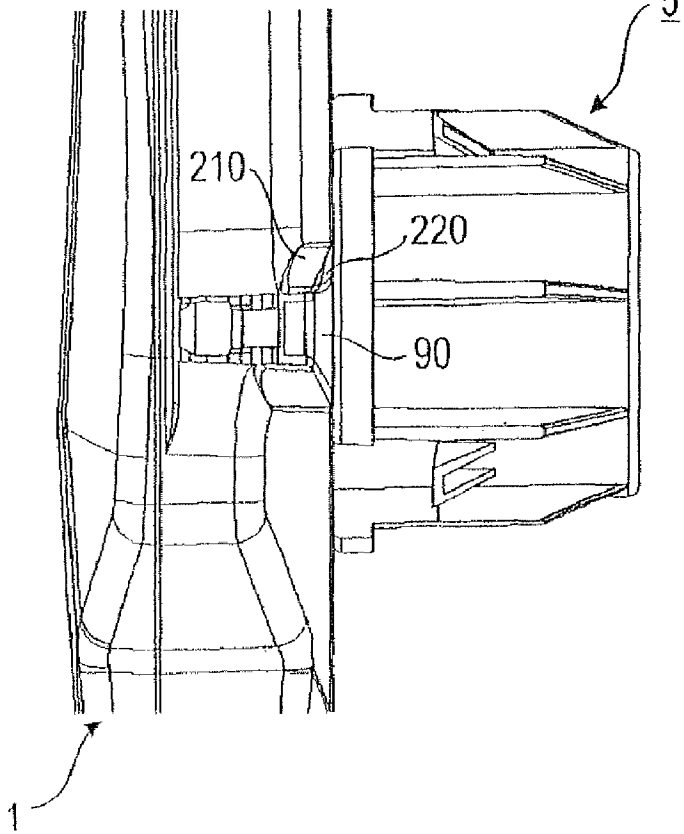
FIG. 20 is a non-sectioned front view of the retention mechanism and the end plug in the position shown in FIGS. 18 and 19.

This same position of the end plug 5 in the retention mechanism 1 is also shown in a non-sectioned front view in FIG. 20. Here, it is clearly becomes apparent that a part of the locking surface 90 is "hidden" behind the locking protrusion 220 of the upper guide rail 210 and, thus, locks the end plug 5 in its end position.

Figure 21:
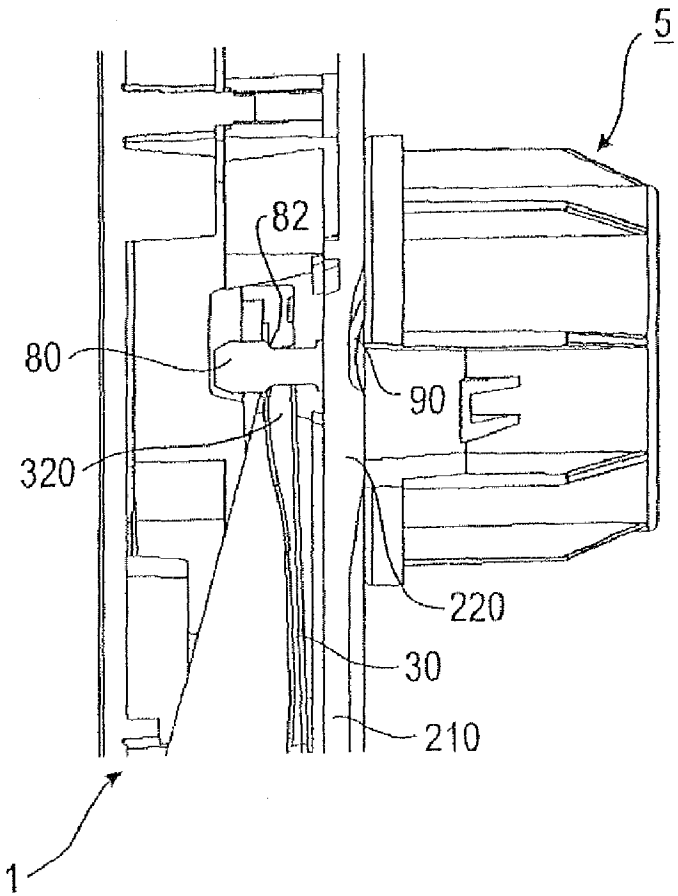
FIG. 21 is a top view of the end plug inserted in its end position in the retention mechanism, as shown in FIGS. 18 to 20, the housing of the retention mechanism being partly broken away.

FIG. 21 shows the end plug 5 in the retention mechanism 1 in a top view with parts of the housing cut away. The locking protrusion 220 of the upper guide rail 210 keeps the end plug 5 via interaction with the locking surface 90 in its end position. Furthermore, the interaction of the counter surface 82 of the bearing pin 80 with the locking protrusion 320 of the counter bracket 30 also keeps the end plug in the end position.

Figure 22:
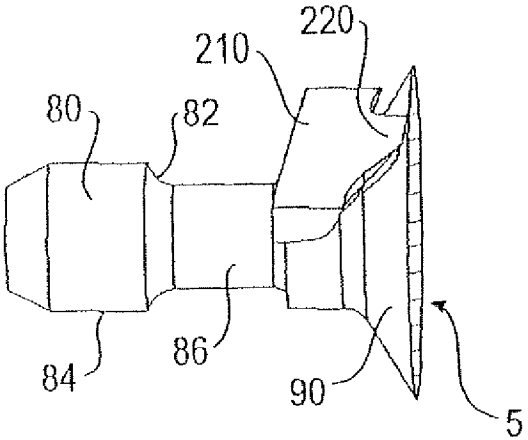
FIG. 22 is an enlargement showing the interaction between the bearing portion of the end plug and the upper guide rail of the insertion slot with the end plug in its end position.

FIG. 22 shows the interaction of the upper guide rail 210 with the locking protrusion 220 and the locking surface 90 of the end plug 5. It has to be noted that the locking protrusion 220 is asymmetric. This asymmetric shape is formed such that, in the insertion direction, the locking protrusion 220 has a smoother slope than in the removal direction. In other words, the widest portion of the locking protrusion 220 is reached in the insertion direction over a longer distance than in the opposite direction. This leads to a situation in which the end plug 5 is firmly held in the end position and a locking force of 18N to 19N is exerted onto the end plug 5.

Figure 23:
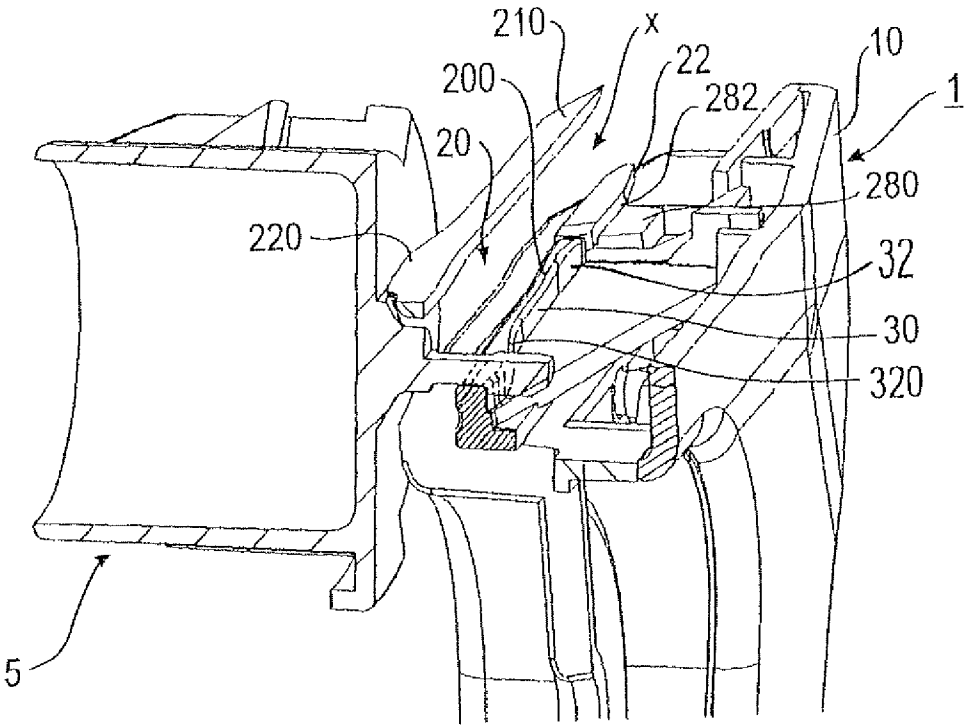
FIG. 23 is a perspective cross-section showing the end plug in its end position within the retention mechanism.

FIG. 23 shows the end plug 5 and the retention mechanism 1 in a perspective cross section. Lower rail 200 and upper rail 210 of the insertion slot 20 are shown. In the upper rail, the locking protrusion 220 is also shown. The counter bracket 30 which is pivotable about pivoting axis 32 is shown as well as the locking protrusion 320 of the counter bracket 30.

The insertion slot 20 is formed between the lower guide rail 200 and the upper guide rail 210. At the entrance section 22 of the insertion slot 20, a prevention section comprising a first prevention member 280 and a second prevention member 282 is situated. The prevention members 280, 282 are formed such that only a end plug 5 with a bearing pin 80 of the correct dimensions can be inserted into the insertion slot 20. To achieve this, the first prevention member 280 ensures that the outer diameter of the first portion 84 of the end plug 80 has a correct outer diameter. If the outer diameter of the first portion 84 of the end plug is too large, the bearing pin 80 cannot pass through this first prevention member 280 of the prevention section. A second prevention member 282 of the prevention section ensures that the second portion 86 of the bearing pin 80 of the end plug has the correct outer diameter. If the outer diameter of the second portion 86 of the bearing pin is too large, the bearing pin cannot slide past this second prevention member 282 of the prevention section. A third prevention mechanism is present in the counter bracket 30 in that the guiding slit in the counter bracket 30 is dimensioned such that only a bearing pin with the correct outer diameters can be held in the counter bracket 30. In particular, the guiding slit in the counter bracket 30 has dimensions such that a bearing pin with a too large diameter of the second portion 86 of the bearing pin cannot be inserted into the guiding slit. Furthermore, if the first portion 84 of the bearing pin 80 is too small, a locking surface 82 of the bearing pin 80 cannot come into contact with the rails forming the guiding slit in the counter bracket 30 and the counter bracket 30 will not be pivoted towards the outer wall of the housing 10. Subsequently, a bearing pin with a counter surface 82 of the wrong dimension will fall off the retention mechanism through an exit section 24 of the insertion slot 20, as can be seen in FIG. 24. Such bearing pin of incorrect dimensions would, consequently, be rejected by the retention mechanism 1.

FIGS. 25 to 28 show the upper guide rail 210 in different views and perspectives. The locking protrusion 220 has, in the insertion direction X, a smoother slope than in the opposite direction. In particular, the section 222 extends over a longer distance than the section 224. An end plug inserted into the retention mechanism will, consequently, be locked with its locking surface 90 behind the steeper section 224.

It has been found that the interaction between the inclined locking surface 90 of the bearing member of the end plug with the specific form of the locking protrusion 220 leads to an improved handling of the insertion of the end plug into the retention mechanism. In particular, the end plug can be slid into the end position easily due to the interaction of the inclined surface with the smoother sloped portion 222 of the locking protrusion 220. The end plug snaps then into its end position and sits there firmly whereas the interaction between the inclined locking surface of the end plug and the steeper sloped portion 224 of the locking protrusion 220 results in a locking force of 18 N to 19 N. This particular locking force has been found to be advantageous since it keeps the end plug and the tissue paper roll mounted on the end plug in a fixed position during use but allows, on the other hand, easy replacement of the tissue roll by simply pulling the tissue roll out in a direction opposite to the insertion direction. Thus, the removal process substantially works in the same way as the insertion but backwards.

FIGS. 29 to 32 show, once more, the insertion process of the end plug 5 into the retention mechanism in different perspective.

Figure 29:
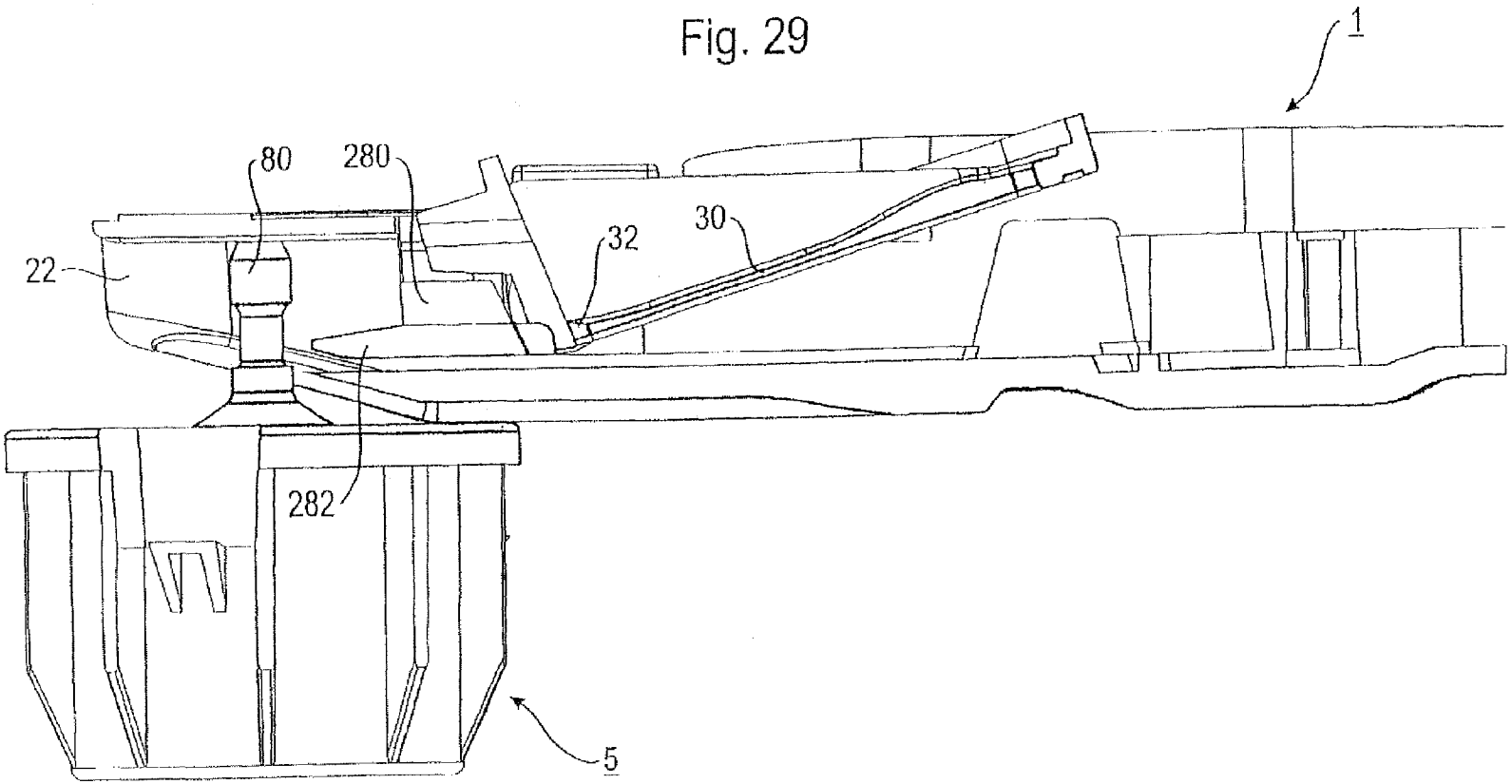
FIG. 29 shows the retention mechanism with an end plug inserted therein in a first position of the end plug in a top view with parts of the housing of the retention mechanism being cut away.

FIG. 29 is a top view showing the end plug and the retention mechanism 1 with parts of the housing of the retention mechanism 1 broken away. The end plug 5 is shown in a position before actually entering the insertion slot. The bearing pin 80 sits in an entrance section 22 of the insertion slot. The prevention members 282 and 280 that were described with regard to FIG. 23, are shown. Furthermore, the counter bracket 30 is shown in an insertion position pivoted about pivoting axis 32.

Figure 30:
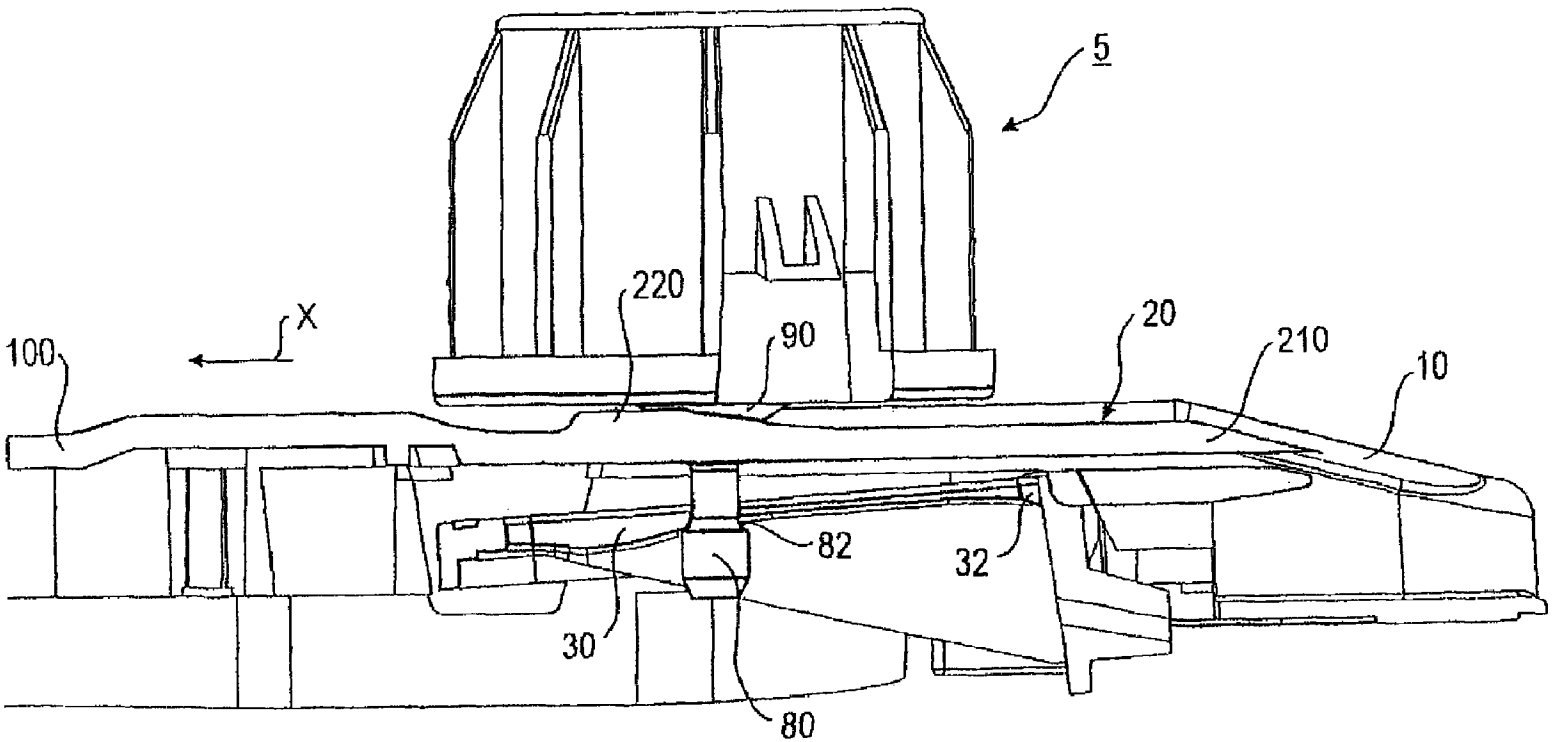
FIG. 30 shows the end plug inserted into the retention mechanism, as in FIG. 29, in a second position.

FIG. 30 shows the end plug 5 in a position slid into the insertion slot in the insertion direction X. The counter surface 82 of the bearing pin 80 interacts with the counter bracket 30 such that the counter bracket 30 is pivoted about the pivoting axis 32 towards the outer wall 100 of the housing 10. The locking surface 90 of the end plug 5 has already started to interact with the locking protrusion 220 of the upper guide rail 210.

Figure 31:
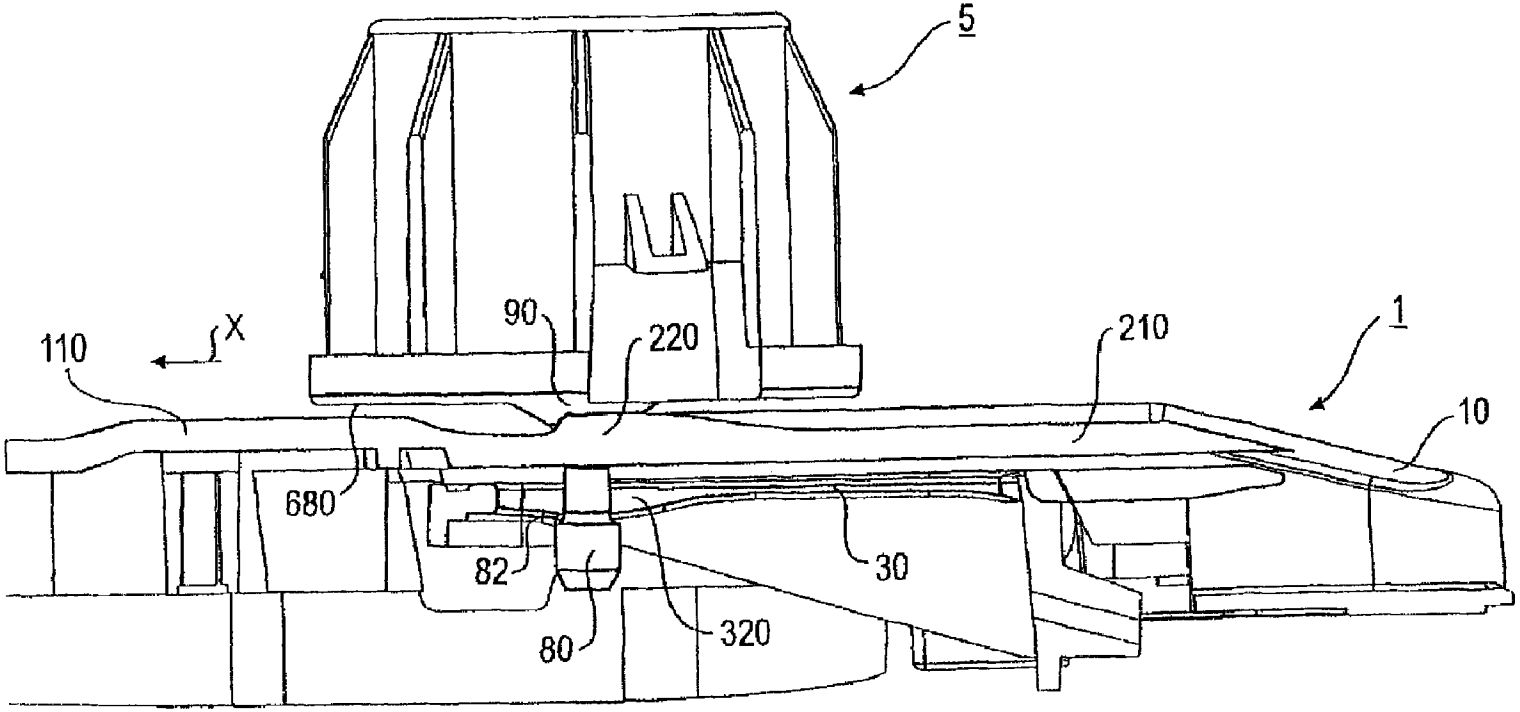
FIG. 31 shows the end plug in the retention mechanism, as in FIGS. 29 and 30, in a third position.

FIG. 31 shows the end plug 5 in the retention mechanism 1 in a third position in which the locking surface 90 of the end plug 5 interacts with the locking protrusion 220 of the upper guide rail 210 such that the end face 680 of the end plug 5 is lifted off the outer surface 110 of the housing 10. The counter surface 82 of the bearing pin 80 also interacts with the locking protrusion 320 of the counter bracket 30 such that an elastic tension is built up between the locking surface 90 and the counter surface 82 by slight deformation of the counter bracket 30 and/or by moving the counter bracket 30 beyond its locking position in a position in which it exerts more tension onto the counter surface 82.

Figure 32:
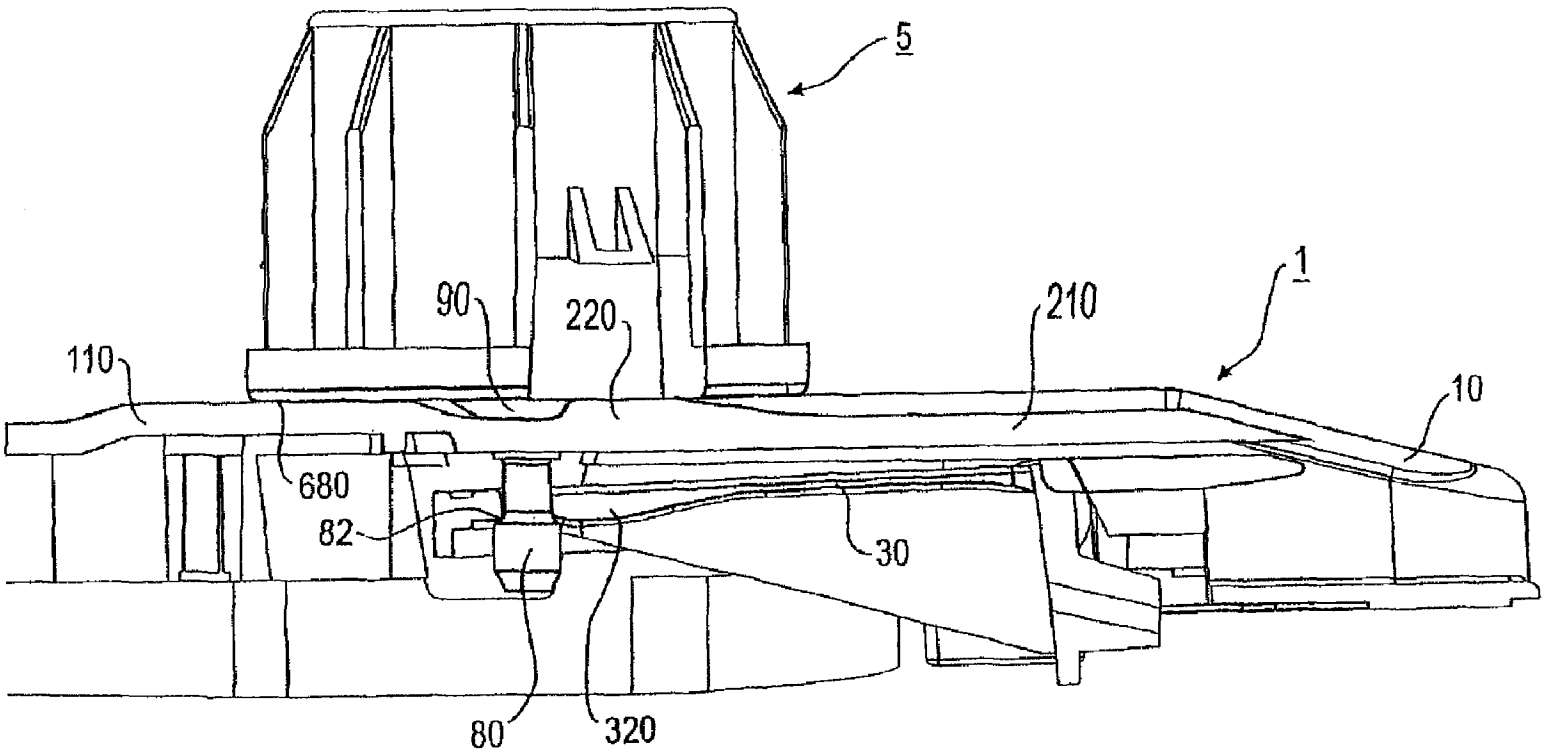
FIG. 32 shows the end plug in an end position in the retention mechanism as shown in FIGS. 29 to 31.

FIG. 32 shows the end plug 5 in its end position in the retention mechanism 1. The end face 680 abuts against the outer surface 110 of the housing 10 and the locking surface 90 of the end plug 5 is slid beyond the locking protrusion 220 of the upper guide rail 210. The counter surface 82 of the bearing pin 80 is also moved beyond the locking protrusion 320 of the counter bracket 30. Consequently, the counter bracket 30 sprung back into its end position, as can be clearly seen by comparing the orientation of the counter bracket 30 in FIGS. 31 and 32. The end plug 5 sits, in this position, firmly in the end position by the interaction of the locking surface 90 of the end plug 5 with the locking protrusion 220.

Figure 33:
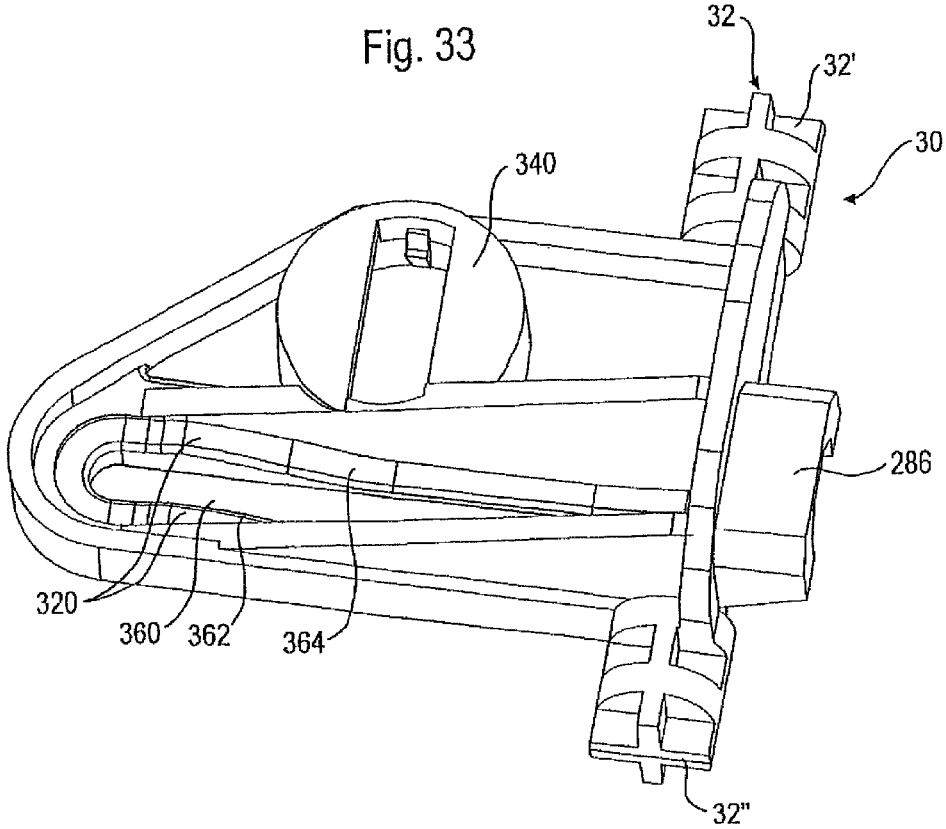
FIG. 33 shows the counter bracket in a perspective view.

FIG. 33 shows the counter bracket 30 in a perspective view. The counter bracket 30 is pivotable about a pivoting axis 32 which is formed by pivoting members 32' and 32". The counter bracket 30 has a guiding slit 360 which is formed by an lower guide rail 362 and an upper guide rail 364. The guiding slit 360 has dimensions to interact with the counter surface 82 of the bearing pin 80, as shown in the previous Figures. In other words, the guiding slit 360 has a width that fits the lower diameter of the second portion 86 of the bearing pin and is able to interact with the counter surface 82. A locking protrusion 320 is formed in the lower guide rail 362 and in the upper guide rail 364. The locking protrusion 320 has a smooth section leading to its widest portion which is situated in the insertion direction and a steeper portion which is situated in the opposite direction.

The guiding bracket 30, furthermore, includes a spring support 340 for accommodating a spring 34, as it is shown in FIG. 1.

A fourth prevention member 286 is provided downstream of the guiding slid 360 in the form of a hood that prevents the insertion of a guiding pin 80 of a end plug 5 that is too long. Such too long guiding pin would, consequently, be rejected by the third prevention portion 286.

Figure 34:
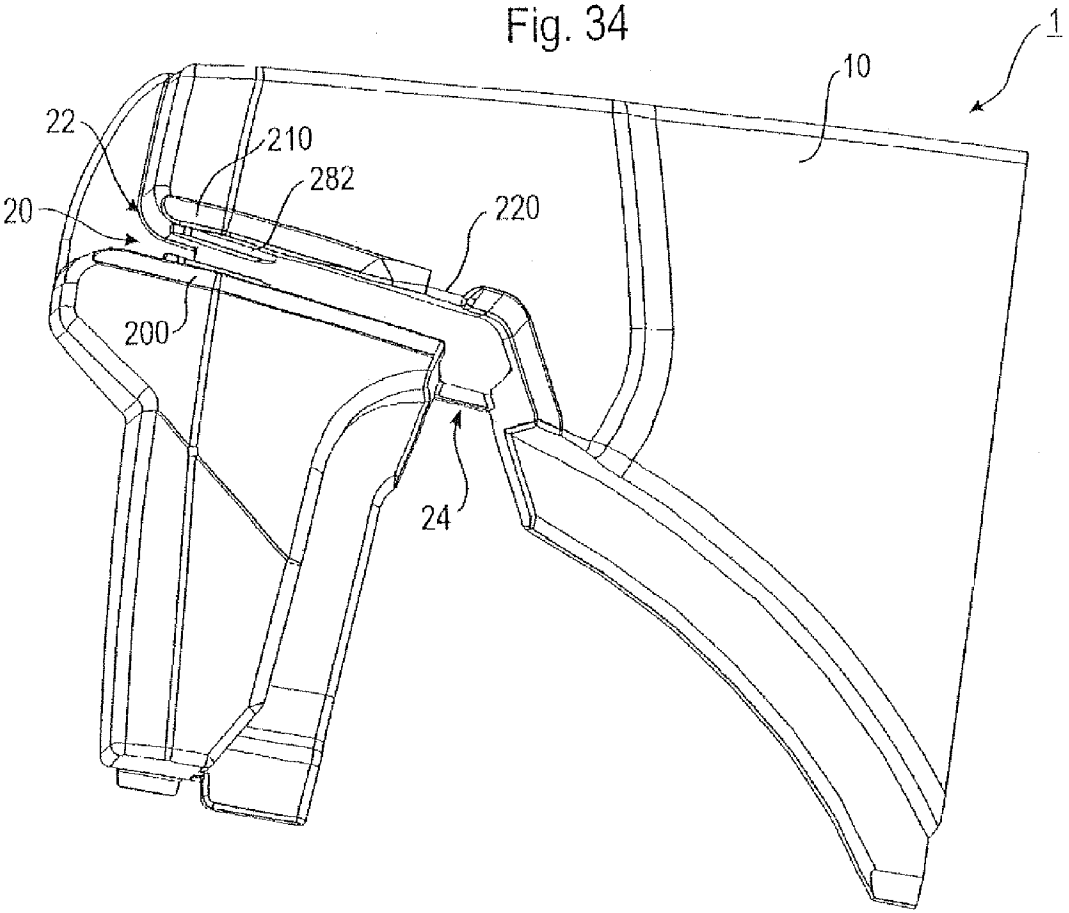
FIG. 34 shows the housing of the retention mechanism in a perspective view.

FIG. 34 shows a perspective view of the housing 10 of the retention mechanism 1. The insertion slot 20, which is formed by the lower guide rail 200 and the upper guide rail 210, is clearly visible. The upper guide rail 210 has the locking protrusion 220 formed therein. The insertion slot 20 has an entrance section 22 and an exit section 24. The exit section 24 serves to reject bearing pins of incorrect dimensions. In particular, bearing pins that have dimensions that are too small fall off the insertion slot 20 through the exit section 24. FIG. 34 also shows that the prevention members 280 and 282 are also present on the upper side of the insertion slot 20.

The invention claimed is:

1. An end plug for a roll of material to be inserted into a retention mechanism, comprising:

a bearing member with dimensions to longitudinally fit into the retention mechanism, a receiving portion with dimensions to fit into a hollow core of the roll of material; wherein the bearing member comprises:

a bearing pin comprising a counter surface facing the receiving portion; and a locking surface for locking the end plug in an end position in the retention mechanism, the locking surface and the counter surface being arranged to be inclined in opposite directions to constitute a potential well, the locking surface being arranged between the receiving portion and the bearing pin, the locking surface having at least one portion inclined with respect to the longitudinal axis of the bearing pin by an angle to the longitudinal axis of the bearing pin in the range of 117° to 141°.

2. The end plug according to claim 1, wherein the locking surface is inclined by an angle to the longitudinal axis of the bearing pin in the range of 120° to 122°.

3. The end plug according to claim 1, wherein the locking surface is inclined by an angle to the longitudinal axis of the bearing pin of 121.1°.

4. The end plug according to claim 3, wherein the angle in combination with the counter surface produces a locking force of 18N to 19N.

5. The end plug according to claim 1, wherein the locking surface is defined by a truncated cone, the base of the truncated cone being oriented towards the receiving portion and the top of the truncated cone being oriented towards the bearing pin.

6. The end plug according to claim 5, wherein the base of the truncated cone has a diameter larger than any outer diameter of the bearing pin.

7. The end plug according to claim 5, wherein the top of the truncated cone has a diameter substantially corresponding to the outer diameter of a portion of the bearing pin adjacent to the top of the truncated cone.

8. The end plug according to claim 5, wherein the top of the truncated cone has a diameter substantially corresponding to the largest diameter of the bearing pin, said diameter being about 5 mm.

9. The end plug according to claim 1, wherein a distance portion is arranged between the locking surface and the receiving portion.

10. The end plug according to claim 9, wherein the distance portion is cylindrical and/or has inclined surfaces with respect to the longitudinal axis of the bearing pin.

11. The end plug according to claim 1, further comprising a limiting member for limiting the depth of insertion of the receiving portion into the hollow core of the roll of material, the limiting member being situated adjacent the receiving portion.

12. The end plug according to claim 11, wherein the limiting member is flange-shaped or ring-shaped.

13. The end plug according to claim 11, wherein the locking surface extends beyond an end face of the receiving portion, by about 2 mm beyond a plane of the end face.

14. The end plug according to claim 11, wherein portions extending beyond the limiting member and/or the receiving portion in a direction of the bearing pin are rotationally symmetric.

15. The end plug according to claim 1, wherein the bearing pin comprises at least a first portion of a first outer diameter and a second portion of a second outer diameter, the second portion being situated between the first portion of the bearing pin and the locking surface, and the second outer diameter being smaller than the first outer diameter.

16. The end plug according to claim 15, wherein the counter surface is arranged between the first portion and the second portion of the bearing pin.

17. The end plug according to claim 16, wherein the counter surface extends in a plane substantially perpendicular to the longitudinal axis of the bearing pin.

18. The end plug according to claim 15, wherein the bearing pin comprises a third portion of a third outer diameter, the third portion being arranged between the second portion and the locking surface, the third outer diameter being larger than the second outer diameter.

19. The end plug according to claim 18, wherein a chamfer having a chamfer radius, is situated between the second portion and the third portion.

20. The end plug according to claim 1, wherein the angle in combination with the counter surface produces a locking force of 15N to 19N.

21. A roll of material for use in a retention mechanism being provided, at least at one longitudinal end of the roll, with an end plug according to claim 1.

22. An end plug for a roll of material to be inserted into a retention mechanism, comprising:

a bearing member with dimensions to fit longitudinally into the retention mechanism, a receiving portion with dimensions to fit into a hollow core of the roll of material; wherein the bearing member comprises:

a bearing pin comprising a counter surface facing the receiving portion; and a locking surface for locking the end plug in an end position in the retention mechanism, the locking surface and the counter surface being arranged to be inclined in opposite directions to constitute a potential well, the locking surface being arranged between the receiving portion and the bearing pin, the locking surface having at least one portion inclined with respect to the longitudinal axis of the bearing pin by an angle to the longitudinal axis of the bearing pin in the range of 117° to 141°, and the angle in combination with the counter surface produces a locking force of 15N to 19N.

* * * * *